US010443824B2

(12) United States Patent
Quaal et al.

(10) Patent No.: US 10,443,824 B2
(45) Date of Patent: Oct. 15, 2019

(54) SIGN BOX LIGHTING SYSTEM

(71) Applicant: The Sloan Company, Inc., Ventura, CA (US)

(72) Inventors: Bruce Quaal, Ventura, CA (US); Timothy Drew Ferrie, Ojai, CA (US); Aaron Meyer, Ventura, CA (US); Chad Chu, Camarillo, CA (US)

(73) Assignee: The Sloan Company, Inc., Ventura, CA (US)

( * ) Notice: Subject to any disclaimer, the term of this patent is extended or adjusted under 35 U.S.C. 154(b) by 487 days.

(21) Appl. No.: 14/101,182

(22) Filed: Dec. 9, 2013

(65) Prior Publication Data

US 2014/0268786 A1 Sep. 18, 2014

Related U.S. Application Data

(63) Continuation-in-part of application No. 14/100,983, filed on Dec. 9, 2013.

(Continued)

(51) Int. Cl.
*F21V 21/088* (2006.01)
*G09F 13/04* (2006.01)

(Continued)

(52) U.S. Cl.
CPC ..... *F21V 21/088* (2013.01); *F21S 2/005* (2013.01); *F21V 21/14* (2013.01); *G09F 13/04* (2013.01);

(Continued)

(58) Field of Classification Search
CPC ..... G09F 13/0413; G09F 13/04; G09F 13/08; G09F 13/10; G09F 13/22;

(Continued)

(56) References Cited

U.S. PATENT DOCUMENTS 3,823,443 A * 7/1974 Takabayashi ..... A44B 11/12 24/186
4,038,726 A * 8/1977 Takabayashi ..... A44B 11/06 24/169

(Continued)

FOREIGN PATENT DOCUMENTS

EP 2365479 9/2011
EP 2365479 A1 9/2011

(Continued)

OTHER PUBLICATIONS

Invitation to Pay Additional Fees from PCT/US2014/028569, dated Jul. 15, 2014.

(Continued)

*Primary Examiner* — Bryon T Gyllstrom
*Assistant Examiner* — James M Endo
(74) *Attorney, Agent, or Firm* — Ferguson Case Orr Paterson LLP

(57) ABSTRACT

A lighting system having a light box housing, a plurality of lighting units, a plurality of light emitting elements mounted on a PCB. The lighting units can also be interconnected in a daisy-chain configuration on at least one carrier, such that the lighting units form an array of lighting units. The array of lighting units adapted to be mounted within the light box housing, wherein the light box housing has one or more arrays of lighting units.

43 Claims, 20 Drawing Sheets

Related U.S. Application Data

(60) Provisional application No. 61/794,517, filed on Mar. 15, 2013.

(51) Int. Cl.

| | |
|---|---|
| ***G09F 13/22*** | (2006.01) |
| ***F21S 2/00*** | (2016.01) |
| ***F21V 21/14*** | (2006.01) |
| ***F21S 4/20*** | (2016.01) |
| ***F21V 21/005*** | (2006.01) |
| ***F21V 23/00*** | (2015.01) |
| ***F21S 4/22*** | (2016.01) |
| ***F21V 17/00*** | (2006.01) |
| *G09F 13/10* | (2006.01) |
| *G09F 13/08* | (2006.01) |

(52) U.S. Cl.
CPC ..... *G09F 13/22* (2013.01); *F21S 4/20* (2016.01); *F21S 4/22* (2016.01); *F21V 17/007* (2013.01); *F21V 21/005* (2013.01); *F21V 23/001* (2013.01); *G09F 13/0413* (2013.01); *G09F 13/08* (2013.01); *G09F 13/10* (2013.01); *G09F 2013/222* (2013.01)

(58) Field of Classification Search
CPC ..... G09F 2013/222; G09F 2013/225; G09F 2013/0477; G09F 2013/0445; G09F 2013/0413; F21S 2/005; F21S 2/00; F21S 4/22; F21S 4/20; F21S 4/28; F21S 4/24; F21S 8/043; F21S 8/068; F21V 21/088; F21V 21/0885; F21V 21/005; F21V 21/14; F21V 21/26; F21V 17/007; F21V 17/002; F21V 23/001; F21V 15/013; F21V 19/0055; F21V 19/02; F21V 23/06; H05K 9/0055; H05K 9/02; H05K 9/0043; Y10T 24/4453; Y10T 24/44538; Y10T 24/44299; Y10T 24/44547; F21K 9/17; Y02B 20/386; H01R 13/62; H01R 13/621; H01R 13/6272; H01R 4/5066
USPC ..... 40/544; 362/133, 249.133, 249.15, 362/249.04, 249.03, 249.06, 249.07, 362/249.08, 249.16, 370, 217.12, 249.11, 362/217.13, 217.11, 217.16, 368, 249.01, 362/219; 428/316.5, 229.13, 229.23, 428/231.51, 216.1, 500, 505, 316.7, 428/316.6, 295.11, 316.4, 227.2, 231.85, 428/231.61, 225.21, 225.11, 221.11, 428/221.12, 222.14, 223.36, 223.41, 428/224.7, 300, 301; 24/516, 514, 535, 24/562, 569; 445/2; 439/725
See application file for complete search history.

(56) References Cited

U.S. PATENT DOCUMENTS 5,452,187 A * 9/1995 Belfer ..... F21V 21/32 362/221
5,622,341 A * 4/1997 Stana ..... F16L 3/13 248/221.11
5,689,860 A * 11/1997 Matoba ..... F16G 11/00 24/115 F
5,697,175 A 12/1997 Schwartz
5,772,311 A * 6/1998 Williams ..... F21S 2/00 362/152
5,794,897 A * 8/1998 Jobin ..... H02G 7/053 24/459
5,900,850 A * 5/1999 Bailey ..... G09F 9/33 340/815.83
5,941,483 A * 8/1999 Baginski ..... F16L 3/22 248/68.1
5,979,095 A * 11/1999 Schneider ..... G09F 3/005 24/704.1
6,362,801 B1 * 3/2002 Yuhara ..... G09F 9/3026 345/82
6,418,010 B1 * 7/2002 Sawyer ..... B60R 11/0235 248/918
6,505,956 B1 * 1/2003 Priddy ..... F21V 17/007 362/249.04
6,558,021 B2 * 5/2003 Wu ..... G09F 13/22 340/815.45
6,677,918 B2 * 1/2004 Yuhara ..... G09F 9/33 345/1.3
6,685,385 B1 * 2/2004 Ledingham ..... F16B 2/065 403/3
7,013,535 B2 * 3/2006 Tracy ..... A44B 99/00 24/115 H
7,712,950 B1 * 5/2010 Addario ..... B60Q 1/305 362/370
7,740,386 B2 * 6/2010 Tsuji ..... F21V 21/002 362/249.02
7,808,386 B1 * 10/2010 Sayegh ..... E05B 73/0017 235/385
7,996,963 B2 * 8/2011 Cameron ..... B60P 7/0823 24/344
8,695,290 B1 * 4/2014 Kim ..... F24J 2/5252 248/225.11
2003/0183413 A1 * 10/2003 Kato ..... H02G 3/32 174/135
2003/0213882 A1 * 11/2003 Chen ..... F16M 13/02 248/316.1
2003/0218878 A1 * 11/2003 Swaris ..... F21S 4/20 362/234
2004/0196651 A1 * 10/2004 Newbold ..... F21S 2/00 362/133
2005/0050779 A1 * 3/2005 Tsao ..... G09F 9/33 40/544
2006/0039142 A1 * 2/2006 Temple ..... G09F 9/33 362/231
2006/0082987 A1 * 4/2006 Dorsey ..... F21S 48/215 362/103
2006/0129103 A1 * 6/2006 Bierman ..... A61M 25/02 604/174
2007/0200045 A1 * 8/2007 Ayotte ..... B60Q 7/02 248/505
2007/0283729 A1 * 12/2007 Saitoh ..... E05B 73/0017 70/57.1
2008/0232105 A1 * 9/2008 Saha ..... B29C 45/14065 362/267
2008/0244944 A1 * 10/2008 Nall ..... G09F 13/04 40/544
2008/0304271 A1 * 12/2008 Lei ..... A63H 3/006 362/382
2009/0073693 A1 * 3/2009 Nall ..... G09F 13/04 362/249.02
2009/0121988 A1 * 5/2009 Amo ..... G09G 3/2088 345/82
2009/0146910 A1 * 6/2009 Gardner ..... F21S 2/005 345/1.3
2009/0266958 A1 * 10/2009 Meersman ..... F16B 2/065 248/231.51
2010/0238663 A1 * 9/2010 Chen ..... G09F 13/22 362/249.03
2011/0019413 A1 * 1/2011 Zimmerman ..... G09F 13/22 362/249.02
2011/0096531 A1 * 4/2011 Frey ..... G02F 1/133305 362/97.4
2011/0134640 A1 * 6/2011 Bertele ..... G09F 9/33 362/249.02
2011/0226919 A1 * 9/2011 Fryzek ..... F21S 8/026 248/298.1
2012/0262920 A1 * 10/2012 Longardner ..... F21V 19/008 362/249.01

(56) References Cited

U.S. PATENT DOCUMENTS

| | | | | |
|---|---|---|---|---|
| 2013/0009019 | A1* | 1/2013 | Fukumoto | F16L 3/2235 248/67.5 |
| 2013/0182440 | A1 | 7/2013 | Ferrie et al. | |
| 2014/0078760 | A1* | 3/2014 | Rossini | B63B 45/02 362/477 |

FOREIGN PATENT DOCUMENTS

| | | | |
|---|---|---|---|
| WO | WO 2012119002 | | 9/2012 |
| WO | WO 2012129567 | | 9/2012 |
| WO | WO 2012129567 | A2 | 9/2012 |
| WO | WO 2014144311 | A2 | 9/2014 |
| WO | WO 2014144311 | A3 | 9/2014 |
| WO | WO 2015088922 | A2 | 6/2015 |

OTHER PUBLICATIONS

Tandem2 product information from US LED Tandem by US LED, two pages.
Tetra Poworstrip LED Lighting System by GE Lighting. 4 pages.
International Search Report and Written Opinion from appl. No. PCT/US2014/068929.
International Preliminary Report on Patentability from appl. No. PCT/US2014/068929. dated Jun. 14, 2016.
Written Opinion from appl. No. PCT/US2014/028659.
Communication from European appl. No. 14720390.5-1801. dated Dec. 15, 2015.
International Preliminary Report on Patentability from appl. No. PCT/US2014/028659. dated Sep. 15, 2015.

* cited by examiner

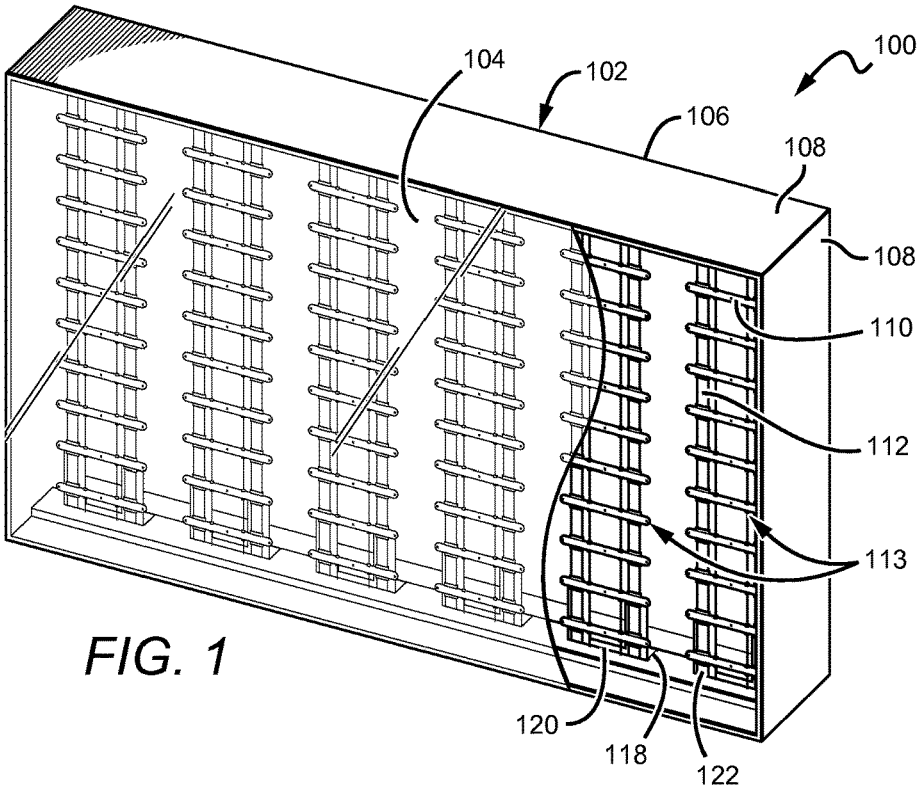
FIG. 1
FIG. 2a
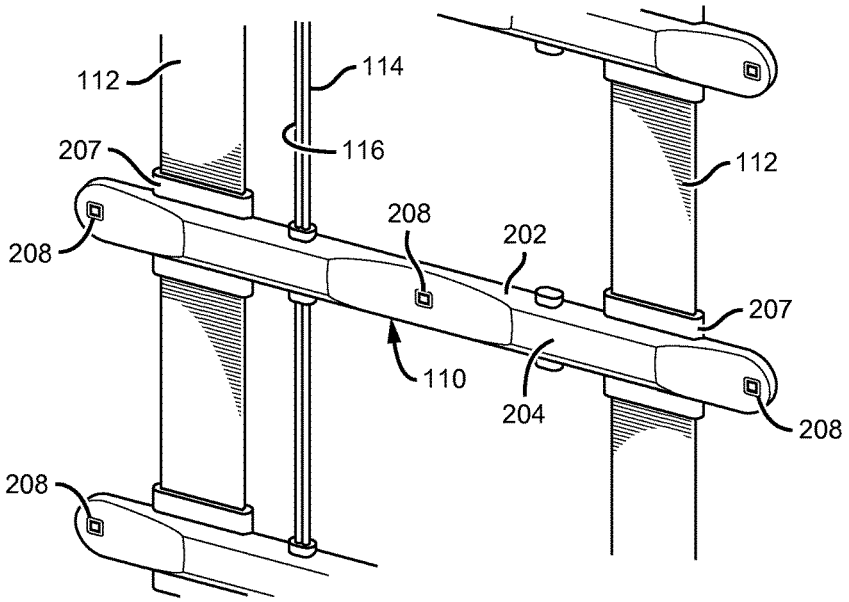

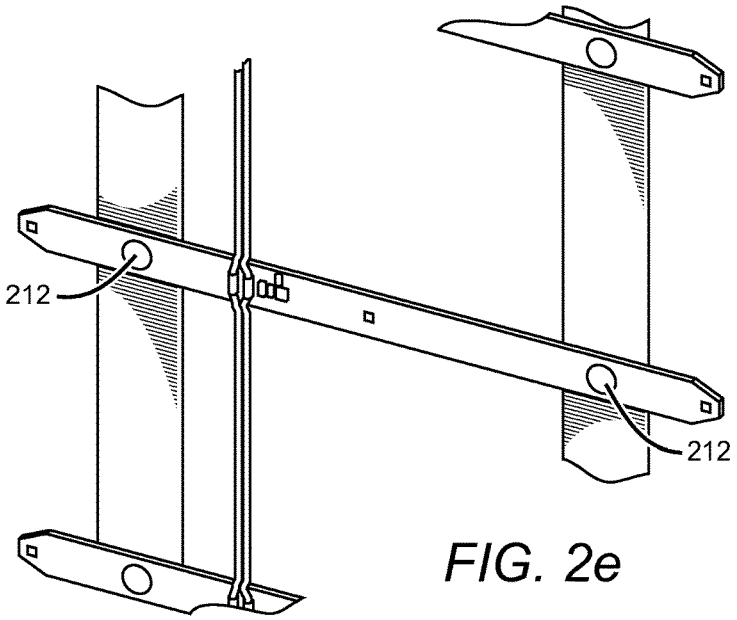
FIG. 2e
FIG. 3a
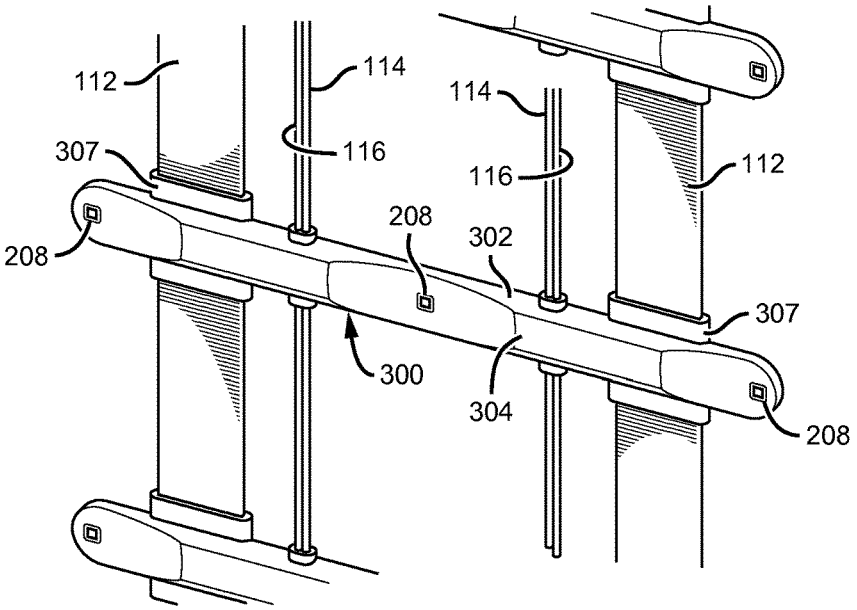

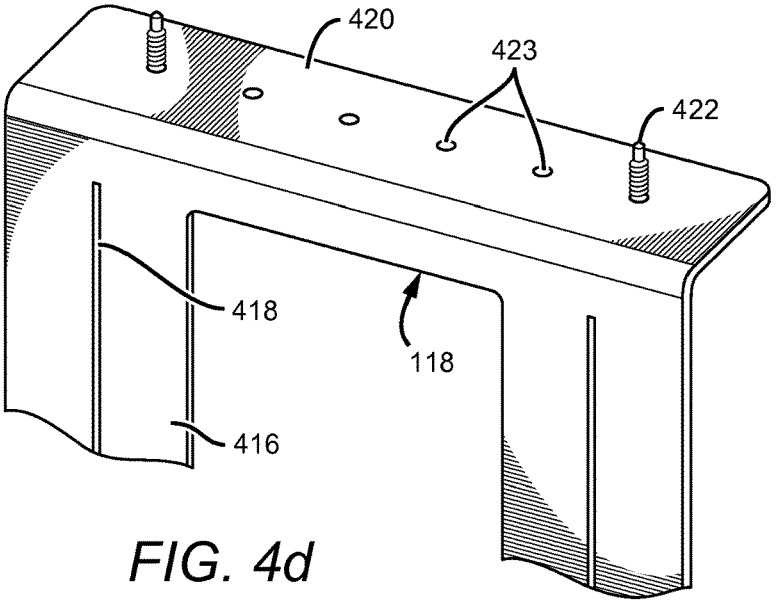
FIG. 4d
FIG. 4e
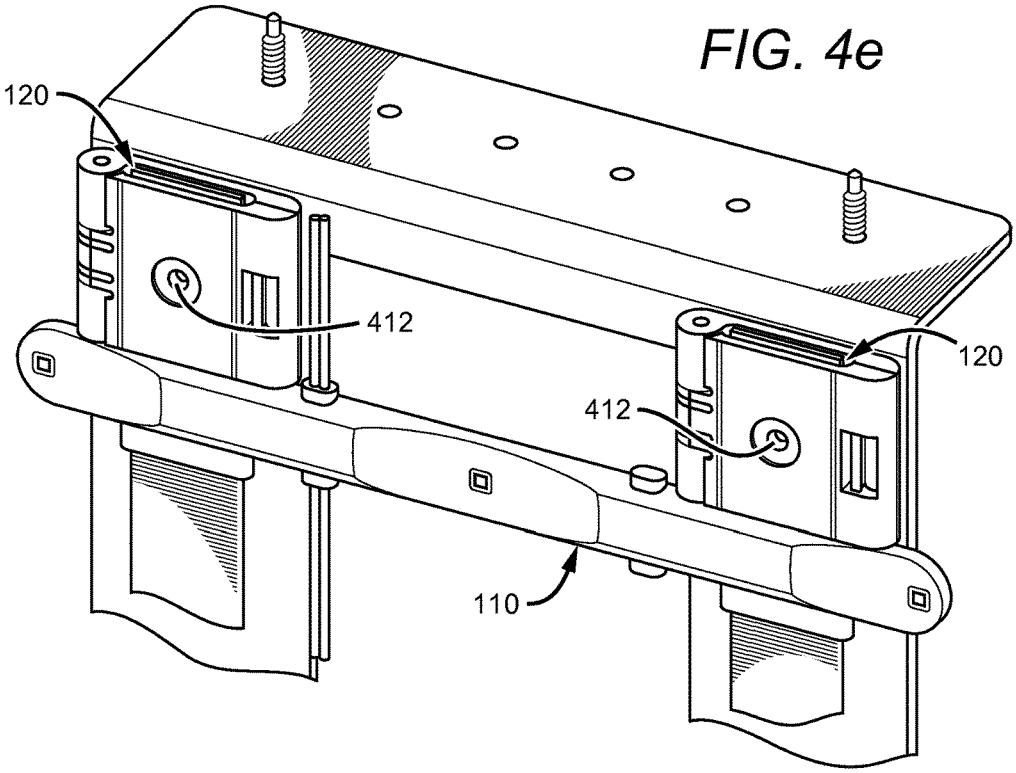

FIG. 5a
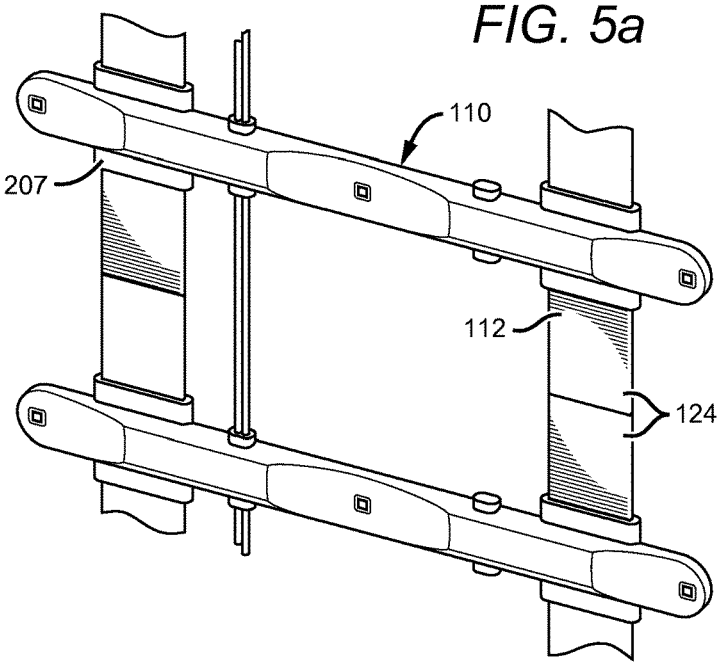
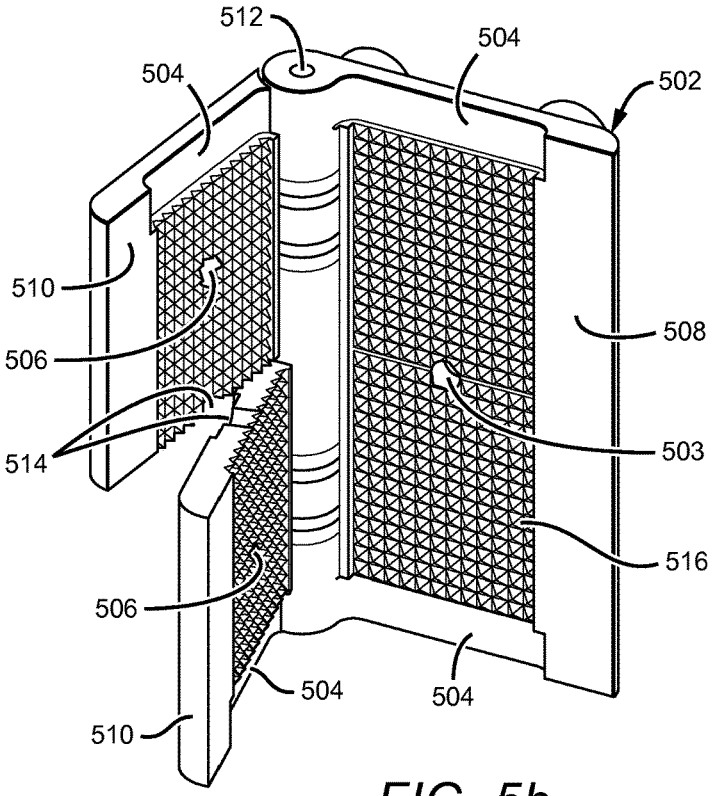
FIG. 5b

FIG. 9b
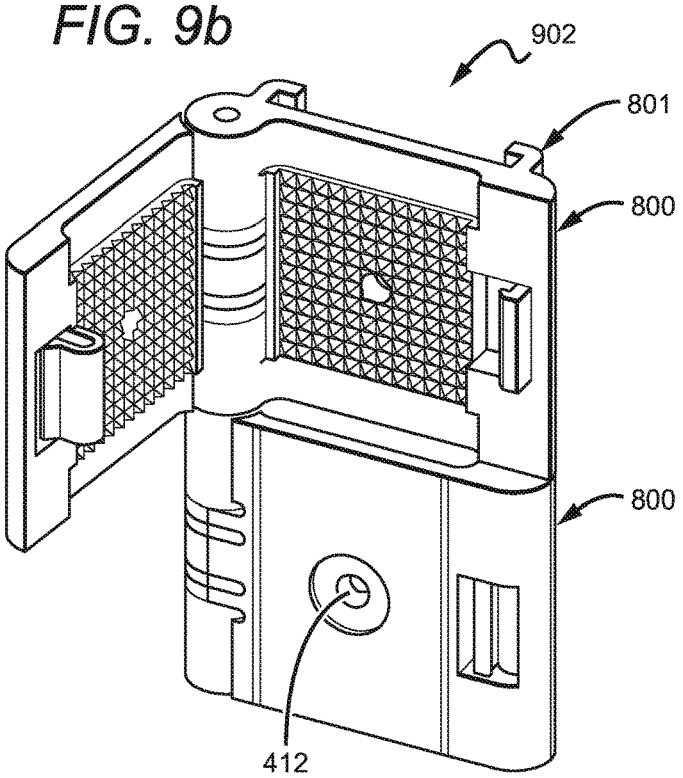
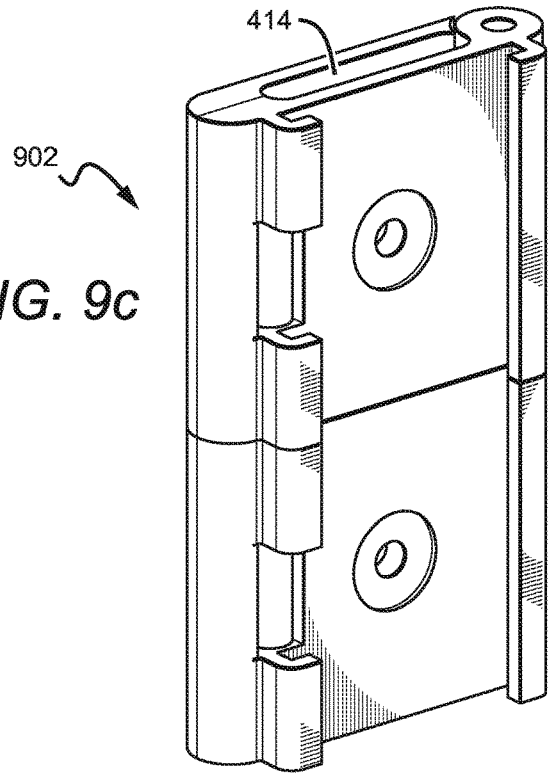
FIG. 9c

FIG. 9f
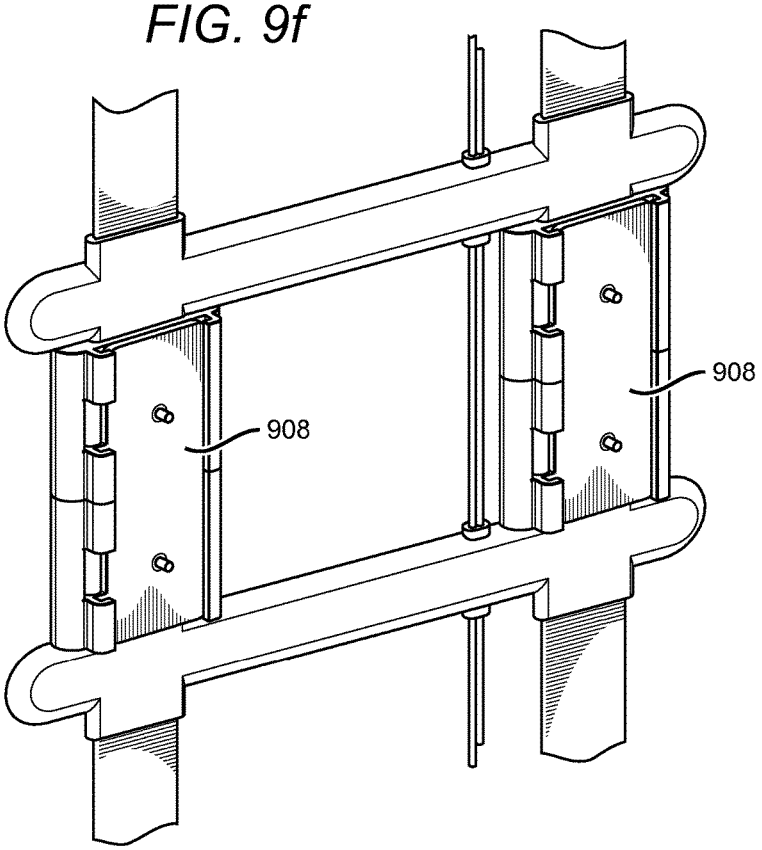
FIG. 10a
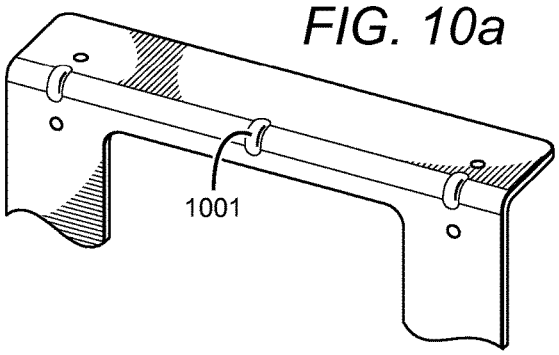
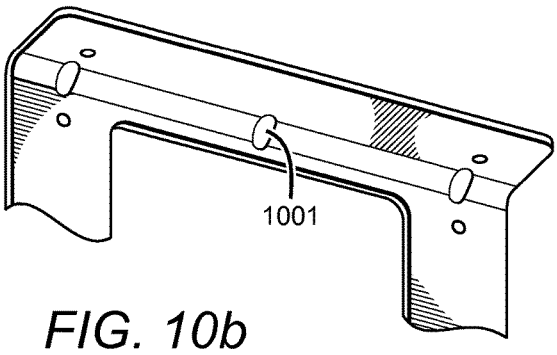
FIG. 10b

FIG. 11a
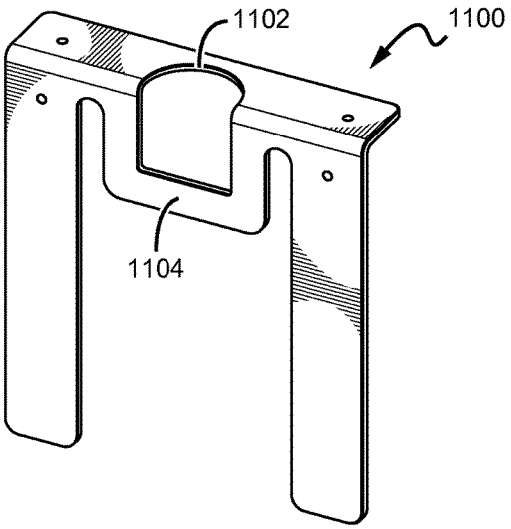
FIG. 11b
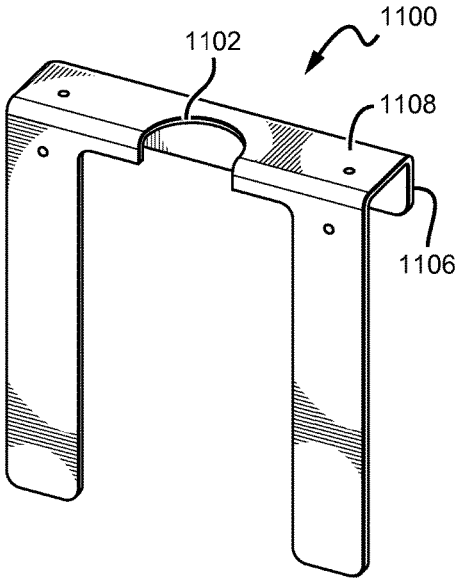
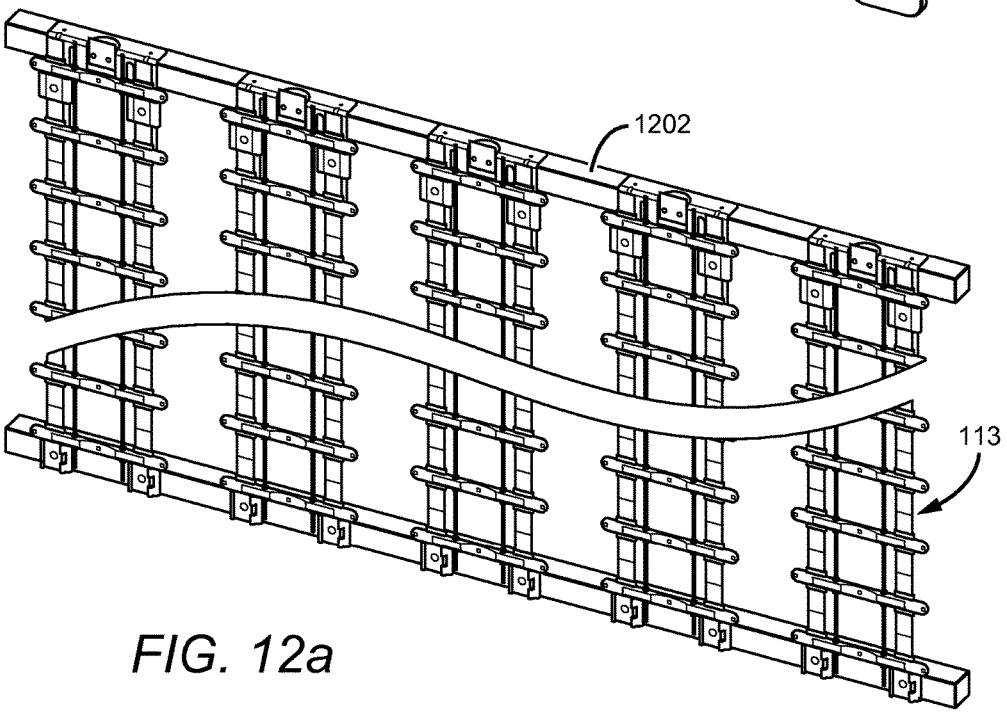
FIG. 12a

SIGN BOX LIGHTING SYSTEM

RELATED APPLICATION

This application is a continuation in part application of Ser. No. 14/100,983 to Quaal et al., filed on Dec. 9, 2013, which claims the benefit of U.S. Provisional Application Ser. No. 61/794,517 to Quaal et al., filed on Mar. 15, 2013. The contents of Ser. Nos. 14/100,983 and 61/794,517, including the drawings, schematics, diagrams and written description, are hereby incorporated in their entirety by reference.

BACKGROUND OF THE INVENTION

Field of the Invention

This invention relates to lighting units using light sources, such as but not limited to light emitting diodes (LEDs) and more particularly to LED based lighting units for illuminating light boxes or sign cabinet lights.

Description of the Related Art

Display units, such as light boxes, cabinet signs and box signs are commonly found on the outside of buildings or businesses and are often used to advertise the name of the business or products. Typical units are constructed of aluminum or plastic housing having the shape of a box and can range from being approximately 5 inches to many feet deep. The housing sometimes has a swing open frame to allow for easily changing the advertising graphics within. The illuminated face in the housing, or surface, is typically covered by a translucent or clear lens that transmits light from within the housing. The advertisement graphic is placed under this lens so that it is between the lens and the lighting units inside the light box. This allows the graphic to be illuminated from behind by the lighting units within the light box. In some cases the translucent lens itself may be the illuminated graphic.

Some light boxes or sign cabinets have graphics on one face and light only illuminates that face, whereas others are double-faced such that the two opposite faces of the light box each have a translucent or clear lens with a graphic and lighting inside the light box or sign cabinet illuminates both of these faces and graphics.

To enhance the visibility of the advertisement within these units, different types of lighting are incorporated. Various types of lighting systems are used with different light sources such as incandescent bulbs, neon bulbs or fluorescent tubes. One of the problems associated with the conventional lighting units and systems is that their light sources can experience relatively short lifespans and they can have relatively low electrical efficiency. Incandescent bulbs, neon bulbs and fluorescent tubes have a relatively short lifespan, particularly when compared to other light sources, such as typical LEDs. These light sources are also electrically inefficient and providing sufficient lighting, especially in large lighting applications, requires the consumption of significant energy. For example, a standard fluorescent tube 60 inches in length consumes as much as 60 to 70 Watts, and conventional display units can utilize many of these tubes. Neon bulbs can also experience difficulty with cold starting, which can lead to failure of the neon bulb.

More recently, with the advent of the efficient solid state lighting sources, these display units have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with a vast majority of the electricity they consume being released as heat rather than light. Fluorescent light bulbs are more energy efficient than incandescent light bulbs, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1,000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours.

The increased efficiency and extended lifetime of LEDs is attractive to many lighting suppliers and has resulted in LED lights being used in place of conventional lighting in different sign applications. For example, U.S. Pat. No. 5,697,175 to Schwartz, discloses a low power illuminated sign that is particularly adapted for use with common EXIT signs over doorways. The back of each sign comprises a reflector with a series of cavities with curved surfaces. Each cavity corresponds to a letter and background area in the sign. LEDs are mounted in the center of the cavities to illuminate the letters or background area. The LEDs are provided on a separate perpendicular circuit board or on a central projection formed in the bottom of the cavities, with light from the LEDS directed outward. The letters and background area of the sign are illuminated by light reflecting forward from the curved surfaces of the cavities, so that the only visible light is from the illumination of the cavities.

LED based light box lighting replacements are available in the marketplace. One such solution comprises a chain of LEDs within a glass tube, mimicking a fluorescent bulb structure. LED based light box lighting is also available from GE Lighting Solutions, East Cleveland, Ohio, under product name Tetra® PowerStrip and Tetra® PowerStrip DS, which comprises overmolded LED lighting modules that each have 3 LEDs. These LEDs are covered by a lens to spread the area of the light outputted. The chain of LED modules is then mounted on a rigid rail or into a rigid tube, each of which is then mounted inside a light box to hold the LEDs in place. In single sided light boxes the light modules can also be mounted directly to the back of the unit.

LED based light box lighting is also available from US LED, Houston, Tex., under product name Tandem2, which comprises pre-assembled 4-foot sections with connector clip and "L-Brackets" for installation. Each light module has several LEDs. The chains of LED modules, in 4-foot sections, are mounted on a rigid rail, each of which is then mounted inside a light box to hold the LEDs in place. In some embodiments these lighting units can be provided as multiple lighting units interconnected by conductors in a chain so that an electrical signal applied to the chain causes the lighting units to emit light. Different lengths of the chain can be utilized for a particular channel letter, with the desired length of chain being cut from the rail and mounted within the light box. Each chain is connected to each other by 24" cables. Power can then be applied to the chain causing the units to emit light. The chains are spaced approximately 9-12" apart within the light box.

Different types of chains can have different numbers of lighting units per a length, or stated differently, a different density of lighting units. These chains are typically sold at a cost per measure of length, and the cost per length is typically greater for lighting systems having higher density. To accommodate the different needs of customers for chains of different densities, many different types of lighting system chains need to be maintained and stored and made available to customers. In some light box applications it may be desirable to have different densities of units in different locations. This can require purchasing multiple chains with different densities for the same job.

Each of the lighting units in the chain also has a certain number of LEDs, such as two, four, eight, sixteen, etc., depending on the embodiment. In certain circumstances it may be desirable to have fewer than all the number of LEDs provided on the units, such as in locations where the illumination should be spread. Conventional lighting units, however, offer little flexibility in reducing the number of LEDs in certain ones or all of the LED units in a chain.

SUMMARY

The invention provides various embodiments of lighting units and systems of manufacturing the same. The invention is configured to be efficient, reliable, cost effective and can be arranged to provide illumination for structural lighting, display lighting and ingress/egress lighting, and is particularly applicable for light boxes or sign cabinet lighting. The different embodiments comprise elements to alter or control the light distribution pattern emitted from the light sources within the lighting unit. The elements can comprise many different materials or devices arranged in different ways, with some devices comprising a plurality of electrically connected lighting units.

In one embodiment, as broadly described herein, a lighting system is disclosed that comprises a light box housing including a front surface and a back surface, a plurality of lighting units, and a mounting mechanism such that the plurality of lighting units are mounted within the light box housing. The plurality of lighting units can be interconnected to form an array of lighting units, such that the array of lighting units is mounted within the light box housing. The lighting system can comprise one or more arrays mounted within the light box housing.

The lighting unit comprises a plurality of light emitting elements on a printed circuit board (PCB). The lighting unit further comprises conductors to provide an electrical current to each of the light emitting elements. The light emitting elements are adapted to emit light in a direction away from the PCB, in response to the electrical current supplied by the conductors. The lighting units can further comprise a mounting mechanism to mount the lighting units within the light box housing.

These and other aspects and advantages of the invention will become apparent from the following detailed description and the accompanying drawings which illustrate by way of example the features of the invention.

BRIEF DESCRIPTION OF THE DRAWINGS

FIG. 1 is a perspective view of a lighting system according to an embodiment of the invention.

FIG. 2*a* is a perspective view of a lighting unit according to an embodiment of the invention.

FIG. 2*e* is a perspective view of the lighting unit shown in FIG. 2*a*.

FIG. 3*a* is a perspective view of a lighting unit according to an embodiment of the invention.

FIG. 4*d* is a perspective view of a mounting bracket according to an embodiment of the invention.

FIG. 4*e* is a perspective view of the clamp shown in FIG. 4*a* and the mounting bracket shown in FIG. 4*d*.

FIG. 5*a* is a perspective view of an array of lighting units according to an embodiment of the invention.

FIG. 5*b* is a perspective view of a coupler according to an embodiment of the invention.

FIG. 9*b* is a perspective view of a coupler according to an embodiment of the invention.

FIG. 9*c* is a rear view of the coupler shown in FIG. 9*b*.

FIG. 9*f* is a rear view of the array of lighting units shown in FIG. 9*a*.

FIG. 10*a* is a perspective view of a mounting bracket according to an embodiment of the invention.

FIG. 10*b* is a rear view of the mounting bracket shown in FIG. 10*a*.

FIG. 11*a* is a perspective view of a mounting bracket according to an embodiment of the invention.

FIG. 11*b* is a perspective view of a mounting bracket according to an embodiment of the invention.

FIG. 12*a* is a perspective view of an array of lighting units according to an embodiment of the invention.

DETAILED DESCRIPTION

Figure 2B:
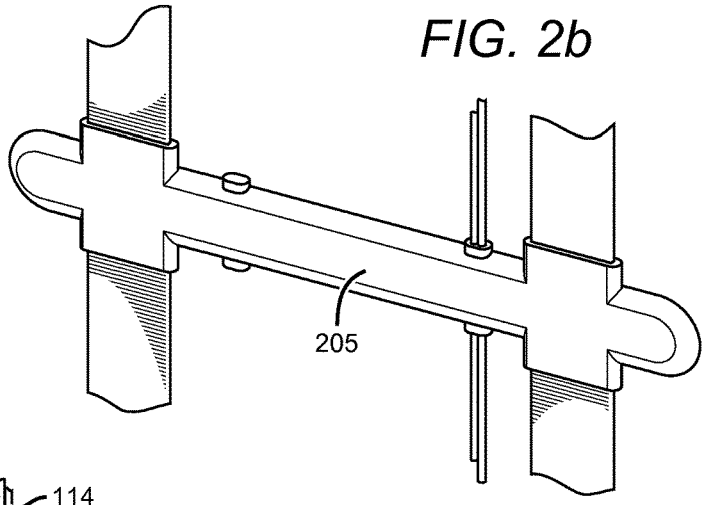
FIG. 2*b* is a rear view of the lighting unit shown in FIG. 2*a*.

The invention described herein is directed to different embodiments of a lighting system that can be used in many different applications such as but not limited to structural lighting, display lighting and ingress/egress lighting. The lighting system according to the invention can be arranged in many different ways with many different components, and is generally arranged to provide illumination for light boxes or sign cabinets. In some embodiments, the lighting system comprises a light box housing and plurality of lighting units, wherein the plurality of lighting units are interconnected in a daisy-chain configuration. Electrical conductors are provided to each of the plurality of lighting units so that an electrical signal applied to the conductors spreads to the lighting units, causing each of the light emitting elements to emit light. The lighting unit can be mounted in various locations within the light box housing. Each of the lighting units can comprise a housing including a top side and a bottom side, and a plurality of light emitting elements mounted on a PCB, wherein the PCB is disposed within the housing.

Light boxes and sign cabinet lighting are generally known in the art and are typically used to illuminate an advertisement or signage within the light box or sign cabinet. Conventional light boxes/sign cabinets comprise a housing, a light source, electronic components to power the light source and a transparent cover. Typical light sources for these conventional light boxes/sign cabinets are, for example, incandescent, neon or fluorescent bulbs. Conventional light boxes/sign cabinets can be mounted to a structure, suspended from a ceiling or mounted to a pole, whereas other conventional light boxes/sign cabinets can be recessed into the structure such that the electronic components are within the structure. These light boxes/sign cabinets can be big and bulky due to the physical dimensions of the necessary high power electronic components and the physical size of the light source. As such, the profile of the conventional light boxes/sign cabinets mounted to or recessed in a wall can extend from the wall such that the light box/sign cabinet is not aesthetically pleasing.

The lighting system of the invention can provide a number of additional advantages beyond those mentioned above. For example, in some embodiments the light emitting elements of the lighting units are LEDs, which are physically smaller than fluorescent and incandescent bulbs typically used in the conventional light boxes/sign cabinets, thereby reducing the profile of the lighting system. Additionally, LEDs operate at a lower power level in comparison to fluorescent and incandescent bulbs and do not need similar high power electronic components, leading to smaller electronic components, a reduction in size of the light box housing and overall weight of the lighting system.

The invention is described herein with reference to certain embodiments but it is understood that the invention can be embodied in many different forms and should not be construed as limited to the embodiments set forth herein. In particular, the invention is described with reference to certain embodiments where the light emitting elements are placed within or on a housing, but in other embodiments this configuration can be modified. The invention can also be used with different types of lighting units used in different applications beyond light boxes and sign cabinets, and although the invention is described herein with reference to light emitting diodes (LED or LEDs) other light sources can be used.

It is to be understood that when an element or component is referred to as being "on" another element or component, it can be directly on the other element or intervening elements may also be present. Furthermore, relative terms such as "between", "within", "adjacent", "below", "proximate" and similar terms, may be used herein to describe a relationship of one element or component to another. It is understood that these terms are intended to encompass different orientations of the device in addition to the orientation depicted in the figures.

Although the terms first, second, etc. may be used herein to describe various elements or components, these elements or components should not be limited by these terms. These terms are only used to distinguish one element or component from another. Thus, a first element discussed herein could be termed a second element without departing from the teachings of the present application. It is understood that actual systems or fixtures embodying the invention can be arranged in many different ways with many more features and elements beyond what is shown in the figures.

Embodiments of the invention are described herein with reference to illustrations that are schematic illustrations. As such, the actual thickness of elements and features can be different, and variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. An element illustrated or described as square or rectangular will typically have rounded or curved features due to normal manufacturing tolerances. Thus, the elements illustrated in the figures are schematic in nature and their shapes are not intended to illustrate the precise shape of a feature of a device and are not intended to limit the scope of the invention.

FIG. 1 shows an embodiment of a lighting system 100 according to the invention. The lighting system 100 comprises a light box housing 102 including a light transmissive face 104, a back 106 opposite the light transmissive face and a plurality of sidewalls 108 separating the light transmissive face 104 and the back 106. The lighting system 100 further comprises a plurality of lighting units 110 within the light box housing 102 on at least one carrier 112, such that the plurality of lighting units 110 on the at least one carrier 112 form an array of lighting units 113. The plurality of lighting units 110 are electrically connected by first and second electrical conductors 114, 116. Each of the lighting units 110 are adapted to emit light in response to an electrical signal.

The electrical conductors 114, 116 conduct electricity to the lighting units 110 and an electrical signal applied to the conductors 114, 116 is conducted to each of the lighting units 110 so that the plurality of lighting units 110 simultaneously emit light. The lighting units 110 are arranged such that, when illuminated, give the appearance that the light box housing 102 has a continuous light source.

The light box housing 102 further comprises a mounting mechanism 119 to mount the plurality of lighting units to the light box housing. The mounting mechanism 119 can be comprised of at least one pair of mounting brackets 118 mounted to opposing sidewalls 108 of the light box housing 102. The at least one pair of mounting brackets 118 are adapted to receive an array of lighting units 113. The array of lighting units 113 is received by the at least one pair of mounting brackets 118 by coupling an endpoint 120 of the array to a respective mounting bracket 118. In one embodiment of the invention, the array of lighting units 113 are arranged in a linear array. As such, the pair of mounting bracket 118 are aligned on opposing sidewalls 108 such that the array endpoints 120 can be properly mounted to the pair of mounting bracket 118. Proper alignment of the pair of mounting brackets 118 allows the array of lighting units 113 to be properly positioned within the light box housing 102, which allows the light emitted from the array of lighting units to be evenly emitted out the light transmissive face 104.

The endpoints 120 of the array 113 are received by a clamp 122, wherein the clamp 122 is coupled to a respective end 124 of the at least one carrier 112. The carrier 112 and clamp 122 combination are coupled to one of the pair of mounting brackets 118 in order to mount the array of lighting units 113 within the light box housing 102. In the embodiment of FIG. 1, the array of lighting units 113 is comprised of a plurality of lighting units 110 on two carriers 112, wherein each carrier 112 is received by a respective clamp 122 at a respective end 124 of each carrier 112. The ends 124 and clamps 122 are then coupled to the pair of mounting brackets 118, whereby the array of lighting units 113 is mounted within the light box housing 102. However, in other embodiments, the ends 124 and clamps 122 can be secured to the light box housing structure itself, without the mounting brackets. The light box housing 102 can comprise a plurality of arrays 113 mounted within the light box housing. However, in other embodiments, the light box housing 102 can be arranged to comprise at least one array of lighting units 113. The array 113 can be configured in many different ways and is not intended to be limited to the embodiments discussed herein. In other embodiments, the array can be arranged to comprise one carrier 112 or more than two carriers 112. In yet other embodiments, the array can be arranged in a non-linear array, such as but not limited to curved, bent or the like.

The light box housing 102 can be configured such that the light transmissive face 104 includes a transparent, translucent, or graphic covered cover. The light transmissive face can be formed of many different materials, such as but not limited to, plastic, tempered glass or the like. In embodiments where the light transmissive face 104 comprises a translucent or graphics covered cover, the light emitted from the lighting units 110 can be diffused by either the features of the lighting units or the translucent or graphics cover, so as to give the appearance that the lighting system 100 has a continuous light source.

Each of the lighting units can comprise a plurality of light emitting elements 208. The light emitting elements may be arranged in many different ways. The lighting units 110 can have any number of light emitting elements, but the examples shown herein have either 3 or 6 light emitting elements. The light emitting elements 208 emit light out from the lighting unit 110 in response to an electrical signal. The electrical conductors 114, 116 conduct electricity to the lighting units 110 and an electrical signal applied to the conductors 114, 116 is conducted to each of the lighting units 110 so that the light emitting elements 208 on each of the lighting units simultaneously emit light. The lighting units 110 are particularly adapted to being mounted in the light box housing 102 or sign cabinet lighting, wherein the light transmissive face 104 of the light box housing 102 is the light emitting surface of the lighting system 100. In some embodiments, the lighting system 100 is configured to be mounted on a wall or similar structure, such that substantially all light is emitted out the light transmissive face 104 of the light box housing 102. In other embodiments, the lighting system 100 can be recessed mounted into a wall or similar structure, while in other embodiments the lighting system 100 can be mounted to a pole or other stand-alone structures.

FIGS. 2*a*-2*e* disclose an embodiment of the lighting units 110 according to the invention, and disclose additional components or features that may be included in the lighting system 100. For the same or similar elements or features, the same reference numbers will be used throughout the application herein. The lighting units 110 comprise a housing 202 having a front surface 204 and a back surface 205, a plurality of light emitting elements 208, a PCB 206 within the housing 202, wherein the plurality of light emitting elements 208 are mounted on the PCB 206 and are exposed through the housing 202. The PCB 206 can be made of many different materials, such as but not limited to a flexible material, rigid material, or any other suitable PCB material. The PCB 206 also comprises at least one slot 210 arranged to receive a fastener 212 to couple the PCB to the at least one carrier 112. The PCB 206 can be arranged to be substantially planar such that the PCB provides a substantially planar surface to receive each of the plurality of light emitting elements 208. However, in other embodiments, the PCB 206 can be arranged to provide at least one angled surface to receive at least one of the plurality of light emitting elements 208. The plurality of light emitting elements 208 can be arranged in a linear configuration on the PCB 206, such that the light emitting elements 208 are separated from adjacent light emitting elements by the same or different distance. The light emitting elements 208 can be arranged in many different configurations on the PCB 206 and is not intended to be limited to a linear configuration.

Figure 2C:
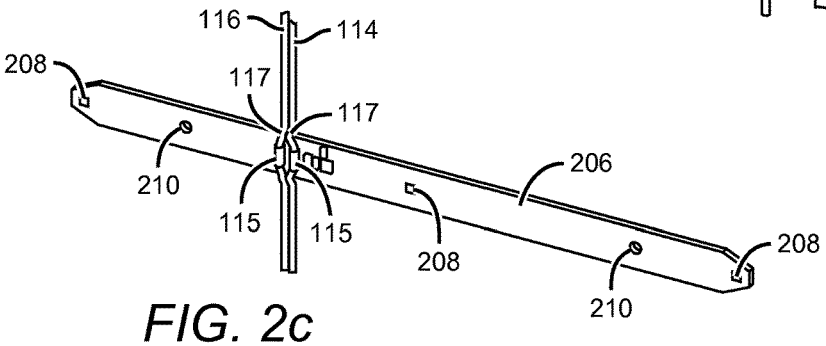
FIG. 2*c* is a perspective view of the lighting unit shown in FIG. 2*a*.

The lighting units 110 further comprise conductors 114, 116 in electrical connection with the PCB 206. As shown in FIG. 2*c*, the PCB 206 comprises crimp terminals 115 configured to receive each of the conductors 114, 116. The conductors 114, 116 are arranged to be a continuous length of conductors and are center-stripped such that the outer insulation of each conductor 114, 116 is removed, leaving part the center conductor 117 of each conductor 114, 116 exposed. The center conductor 117 of each conductor 114, 116 is received by a respective crimp terminal 115, whereby a force is applied to the crimp terminals 115 such that the crimp terminals are compressed tightly around the exposed center conductor 117 of each conductor 114, 116. The crimp terminals 115 can be soldered onto the PCB 206 using a reliable reflow, wave soldering or other solder processes known in the art. The crimp terminals 115 can be coupled to the PCB 206 using a number of different methods known in the art and is not intended to be limited to the embodiments disclosed herein.

An advantage of the invention is that the conductors 114, 116 can be center-stripped at regular intervals, which provides a continuous length of conductors 114, 116 with exposed center conductors 117 of controlled lengths at regular intervals. Center-stripping the conductors 114, 116 at controlled regular intervals allows the PCB 206 to be separated from adjacent PCBs 206 by a spacing corresponding to the controlled regular intervals. This eases the construction and spacing of the lighting units 110 because the exposed center conductors 117 of the conductors 114, 116 provide a visual indication as to where the PCBs 206 are to be connected to the conductors 114, 116. Using center-stripped conductors 114, 116 also eliminates the need of having to cut and strip numerous conductors, especially when connecting a plurality of PCBs into a daisy chain configuration to form an array of lighting units. The center-stripped conductors significantly reduces the amount of time needed to connect numerous PCBs when forming a long array of lighting units, as well as reducing costs related to manufacturing.

Yet another advantage of using center-stripped conductors is that the exposed center conductors 117 provides a large surface area of exposed center conductor to make positive, reliable contact to the crimp terminals on the PCBs. The crimp terminals 115 when crimped or compressed onto the center conductors 117 firmly holds the conductors 114, 116 in place preventing the center conductor 117 from being released from crimp terminals, which can also provide structural support to the PCB and the lighting units. The conductors 114, 116 being continuous and not cut when connected to the crimp terminals makes pulling the conductors out of the crimp terminal 115 more difficult than if the conductors were cut and crimped in the crimp terminal 115.

The conductors 114, 116 can be electrically connected to the PCB 206 using many different methods, and the invention is not intended to be limited to the embodiments disclosed herein. In other embodiments, the conductors 114, 116 can be electrically connected to the PCB by soldering. In yet other embodiments, Insulation Displacement connectors (IDC) or Insulation Piercing connectors (IPC) can be used to electrically connect the conductors to the PCB 206.

In one embodiment, the conductors 114, 116 can be on the same surface of the PCB 206 as the light emitting elements 208. However, in other embodiments, the conductors can be on either side of the PCB 206. The conductors 114, 116 electrically couple the electrical signal on the conductors 114, 116 to their respective one of the lighting units 110. The PCB 206 can also comprise conductive traces (not shown) to conduct electrical signals from the conductors 114, 116 to the light emitting elements 208 so that an electrical signal applied to the conductors is conducted to the light emitting elements through the traces, causing the light emitting elements to emit light. The conductors 114, 116 are arranged such that the length of conductors 114, 116 between adjacent lighting units 110, is longer than the distance between adjacent lighting units 110. In this arrangement, the conductors 114, 116 between adjacent lighting units 110 are relaxed and not taut, such that any forces acting on the conductors 114, 116 is reduced and/or limited. Reducing the force exerted upon the conductors 114, 116 reduces the potential for failure of the conductors 114, 116 due to strain and/or weight of the lighting units when mounted in the light box housing 102 or while being stored.

The light emitting elements 208 are generally mounted along a longitudinal axis of the PCB 206, although they can also be mounted in other locations. In the embodiment of FIGS. 2*a*-2*e* the lighting unit 110 comprises three light emitting elements 208. The invention is not intended to be limited to only having three light emitting elements. In other embodiments, the lighting units can comprise more or less than three lighting elements, such as but not limited to four, six, and eight or more, that can be mounted in many different locations. The light emitting elements 208 can be any device that emits light in response to an electrical signal, such as but not limited to incandescent lights, lasers, laser diodes, fluorescent light, neon lights, or light emitting diodes (LEDs). The light emitting elements 208 can be an LED arranged to emit different colors of different intensities, with a suitable LED being commercially available emitting high luminous flux white light. One suitable LED would output 150 lumens per watt, however other LEDs have an output that is higher or lower.

In some embodiments, the lighting unit 110 can comprise an optical element proximate each of the light emitting elements. The optical element can be in the form of a lens over each of the light emitting elements, a diffuser proximate the light emitting elements, or a reflector proximate the light emitting elements, or a combination thereof. In yet other embodiments, the optical element may be a separate structure or part of the housing 202. In one embodiment, the optical element can be arranged to diffuse the light emitted from light emitting elements 208 so that the light emitted from the lighting unit has an even light distribution pattern. In some embodiments, the optical element can be arranged to have light altering properties such that the light emitted from the lighting unit 110 is redirected in order to produce a desired light distribution pattern, such as but not limited to a uniform light distribution pattern or a directional light distribution pattern. The optical element can be a separately formed structure that is mounted onto the lighting unit 110 proximate the light emitting elements 208. The optical element can be mounted onto the lighting unit using a variety of methods, such as but not limited to glued onto the lighting unit or mechanically fastened (screws, nails, rivets or the like). In yet other embodiments, the optical element can be overmolded onto the lighting unit.

Figure 2D:
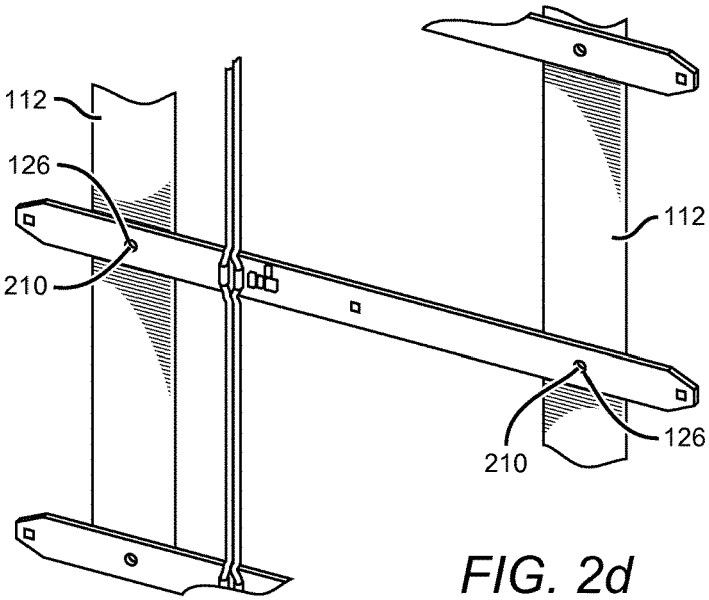
FIG. 2*d* is a perspective view of the lighting unit shown in FIG. 2*a*.

As shown in FIG. 2*c*, the PCB 206 further comprises two slots 210. The slots 210 are arranged to receive a respective fastener 212 in order to couple the PCB to a respective carrier 112. The carrier 112 comprises a plurality of carrier holes 126 that are adapted to receive the respective fastener 212 to couple the PCB 206 to the carrier 112. With reference to FIG. 2*d*, each of the carriers 112 comprise a plurality of linearly aligned carrier holes 126 that are separated from adjacent carrier holes by an equal distance. In order to couple the PCB 206 to the respective carrier 112, the PCB 206 is positioned on each carrier 112 such that the slots 210 of the PCB are aligned with a respective carrier hole 126 of each carrier 112. As shown in FIG. 2*e*, upon the alignment of the slots 210 and the carrier holes 126, a respective fastener 212 can be inserted into the slot and carrier hole, thereby coupling the PCB 206 to each of the two carriers. The fastener 212 can be any type of fastening device, such as but not limited to a button, bolt, clamp, dowel, screw, nail, pin, rivet or the like.

An advantage of the invention is that the carrier holes being separated by an equal distance allows the PCB 206 to be separated from adjacent PCBs by a similar distance, which in turn results in the lighting units 110 being separated from adjacent lighting units 110 by an equal distance.

Another advantage is that the plurality of lighting units 110 mounted on the carriers 112 forms an array of lighting units 113 wherein each of the plurality of lighting units are substantially aligned, which results in the light emitting elements 208 of each lighting unit 110 being substantially aligned. As such, the light emitted from the array 113 has a consistent light radiation pattern and does not vary from the lighting units 110 on the carriers 112. In one embodiment, each of the lighting units 110 of the array 113 are arranged to be substantially perpendicular to the carrier 112. However, in other embodiments, the lighting units can be arranged in a number of different ways, with respect to the carrier, and is not intended to be limited to being substantially perpendicular.

With reference back to FIGS. 2*a*-2*b*, once the PCB 206 is mounted to the carriers, a housing 202 can be placed on the PCB 206. In the embodiment of FIGS. 2*a*-2*b*, the housing 202 is an overmold housing that is overmolded onto the PCB 206 and part of the conductors 114, 116 and part of the carriers 112 that are adjacent the PCB 206. The housing 202 overmolded onto part of the carrier 112 adjacent the PCB 206 forms a shoe 207 that covers part of the carrier 112. The shoe 207 extends outward from the housing 202 and can be arranged to couple the housing 202 to the carrier 112. An advantage of the invention is that the overmolded housing 202 coupled to the carriers 112 provides support to ensure that the PCB 206 remains coupled to the carriers 112. In the event that the fastener 212 were to fail, the overmolded housing 202 would be able to provide support to maintain the positioning of the PCB 206 on the carrier 112. In the embodiment of FIGS. 2*a*-2*b*, each lighting units 110 comprises four shoes 207, two shoes 207 are formed at the area where the PCB 206 is coupled to the carrier 112. Since there are two carriers 112 used in the embodiments of FIGS. 2*a*-2*b* each lighting unit 110 comprises four shoes 207. However, the invention is not intended to be limited to four shoes. In other embodiments, the lighting units can comprise more or less than four shoes. The number of shoes formed could be based on many different factors, such as but not limited to the number of carriers used or the overmold used to form the housing. In other embodiments, the housing can be comprised of a plurality of prefabricated parts that are assembled together to form the housing. In such embodiment, the assembled housing can be bonded to at least one of the PCB 206 and/or the carriers 112 in order to secure the assembled housing to at least one of the PCB and/or the carriers 112. The housing can be arranged in many different configurations and is not intended to be limited to the embodiments disclosed herein.

In yet other embodiments, the lighting unit 110 does not comprise a housing. In such embodiments, the PCB 206 is coupled to the at least one carrier 112 and is exposed in a manner similarly shown in FIG. 2*e*. In such embodiment without a housing, the lighting unit 110 can comprise a protective coating on at least part of the PCB, conductors 114, 116, crimp terminals 115 and/or center conductor 117 or a combination thereof, such that the light emitting elements 208 are exposed and the protective coating is not on the light emitting elements 208. The protective coating can be silicone based or any protective coating known in the art, and can be applied using many different methods known in the art.

The embodiment of the lighting unit shown in FIGS. 2*a*-2*e* is configured to have a single-sided orientation, such that the light emitting elements 208 are on the same side of the lighting unit 110. The embodiment of the lighting unit 300 shown in FIGS. 3*a*-3*e* is configured in a manner similar to the lighting unit 110, but is further configured to have a double-sided orientation such that the light emitting elements 208 are on both sides of the lighting unit 300. The single-sided oriented lighting unit 110 is configured to be used in the lighting system 100, wherein the light transmissive face 104 is the only light emitting surface of the light box housing 102. The double-sided oriented lighting unit 300 is configured to be used in a similar light box housing as the single-sided oriented lighting unit 110, but can also be used in a double-sided light box housing wherein both the light transmissive face 104 and the back 106 are configured to be light emitting surfaces. In such embodiment, both the light transmissive face 104 and the back 106 can comprise a transparent, translucent or graphic cover.

The lighting units 300 comprise a housing 302 having a front surface 304 and a back surface 305, a plurality of light emitting elements 208, a PCB 306 within the housing 302, wherein the plurality of light emitting elements 208 are mounted on the PCB 306 and are exposed through the housing 302. The PCB 306 is similar to the PCB 206 and can be made of many different materials, such as but not limited to a flexible material, rigid material, or any other suitable PCB material. The PCB 306 also comprises at least one slot 210 arranged to receive a fastener 212 to couple the PCB to the at least one carrier 112. The PCB 306 can be arranged to be substantially planar such that the PCB provides a substantially planar surface to receive each of the plurality of light emitting elements 208. However, in other embodiments, the PCB 306 can be arranged to provide at least one angled surface to receive at least one of the plurality of light emitting elements 208. The plurality of light emitting elements 208 can be arranged in a linear configuration on the PCB 306, such that the light emitting elements 208 are separated from adjacent light emitting elements by the same or different distance. The light emitting elements 208 can be arranged in many different configurations on the PCB 306 and is not intended to be limited to a linear configuration.

Figure 3B:
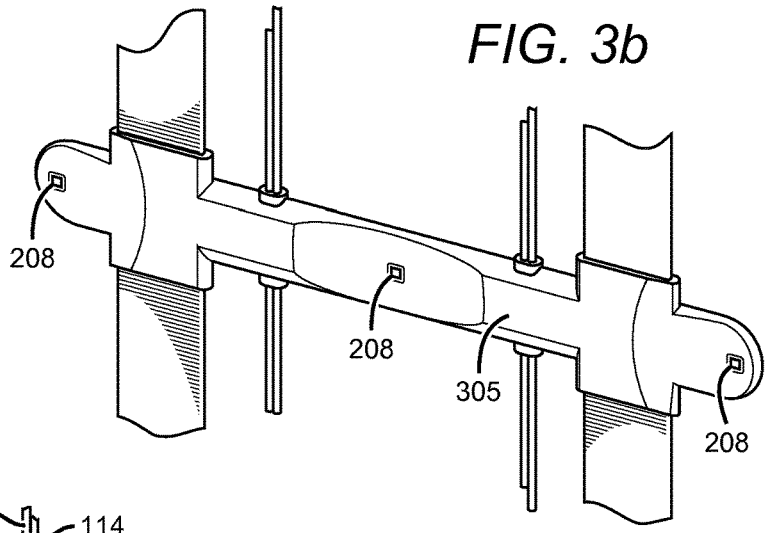
FIG. 3*b* is a rear view of a lighting unit shown in FIG. 3*a*.
Figure 3C:
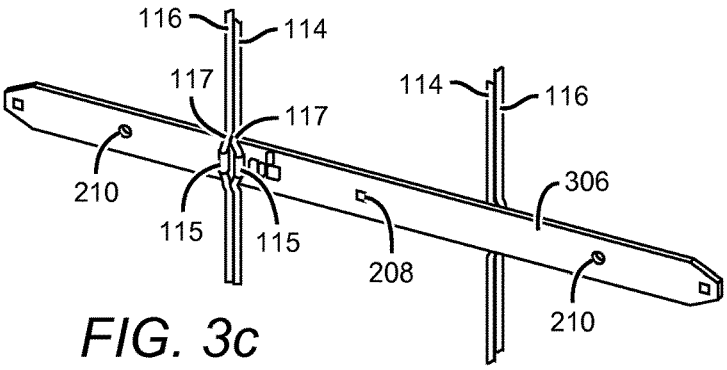
FIG. 3*c* is a perspective view of a lighting unit shown in FIG. 3*a*.

The lighting units 300 further comprise a pair of conductors 114, 116 in electrical connection with the PCB 306. The conductors 114, 116 can be a continuous length of center-stripped conductors exposing the center conductor 117 and electrically connected to the PCB 306 using crimp terminals 115, similarly as discussed above for lighting unit 110. The conductors 114, 116 of the embodiment of FIG. 3*c* are disclosed as being on opposite sides of the PCB 306 and provide an electrical signal to the light emitting elements 208 on the same side. However, in other embodiments, the pair of conductors can be on the same side or different side and still provide an electrical signal to the light emitting elements. In yet other embodiments, the conductors can be on the side of the PCB 306 opposite the light emitting elements 208 such that the conductors provide the electrical signal to the light emitting elements 208 on the other side of the PCB 306.

The conductors 114, 116 electrically couple the electrical signal on the conductors 114, 116 to their respective one of the lighting units 110. The PCB 306 can also comprise conductive traces (not shown) to conduct electrical signals from the conductors 114, 116 to the light emitting elements 208 so that an electrical signal applied to the conductors is conducted to the light emitting elements through the traces, causing the light emitting elements to emit light.

The light emitting elements 208 are generally mounted along a longitudinal axis of the PCB 306 such that the light emitting elements on one side of the PCB are aligned with the light emitting elements on the other side of the PCB. This results in the lighting unit 300 having a light radiation pattern that is the same for both sides of the lighting unit. However, in other embodiments, the light emitting elements 208 on one side of the PCB 306 can be arranged on the PCB in a different arrangement than the light emitting elements on the other side of the PCB. An advantage of this configuration is that the lighting unit can have a different light radiation pattern for each side of the lighting unit, which could be tailored for different lighting solutions.

The lighting unit 300 comprises six light emitting elements 208, with three on each side of the PCB 306. However, the invention is not intended to be limited to only have six light emitting elements. In other embodiments, the lighting units can have any number of light emitting elements on each side. In some embodiments, the number of light emitting elements on both sides of the PCB is the same, while in other embodiments each side of the PCB has a different amount of light emitting elements. The lighting unit 300 can also be configured to have at least one optical element, as discussed above.

Figure 3D:
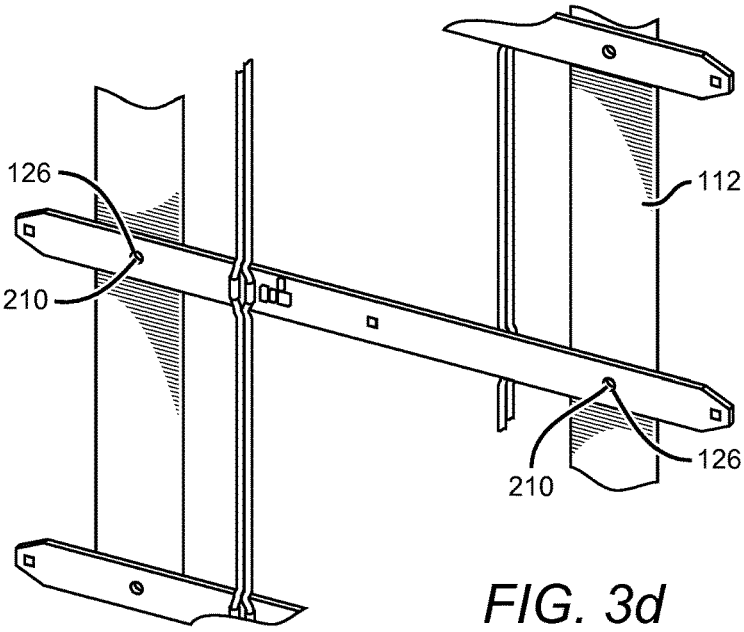
FIG. 3*d* is a perspective view of a lighting unit shown in FIG. 3*a*.
Figure 3E:
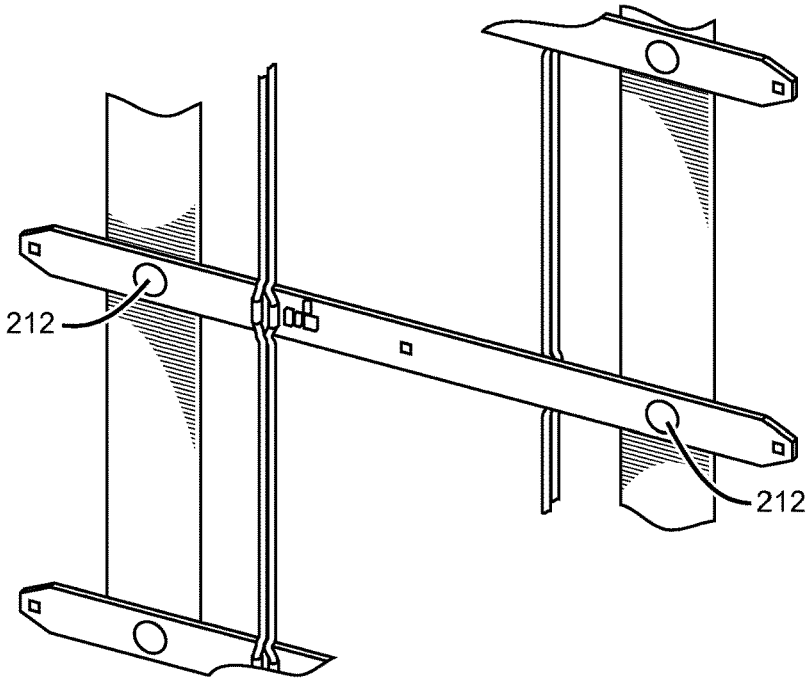
FIG. 3*e* is a perspective view of a lighting unit shown in FIG. 3*a*.

With reference to FIGS. 3*c*-3*e*, the PCB 306 further comprises two slots 210 arranged to receive a respective fastener 212 to couple the PCB to a respective carrier 112. The carrier 112 used with lighting unit 110 can also be used in conjunction with lighting unit 300. Each carrier 112 comprises a plurality of carrier holes 126 adapted to receive a respective fastener 212 to couple the PCB 306 to the carrier. The PCB 306 is coupled to the carrier 112 similarly as PCB 206 is mounted to the carrier 112. The slots 210 of the PCB 306 are aligned with a carrier hole 126 of a respective carrier 112 and a fastener 212 is inserted into the slot 210 and carrier hole 126 which couples the PCB to the respective carrier 112.

Referring back to FIGS. 3*a*-3*b*, once the PCB 306 is mounted to the carriers 112, a housing 302 can be placed on the PCB 306. The housing 302 can be an overmold housing that is overmolded onto the PCB 306 and part of the conductors 114, 116 and part of the carriers 112 that are adjacent the PCB 306. The housing 302 overmolded onto part of the carrier 112 adjacent the PCB 306 forms a shoe 307 that covers part of the carrier 112, similar to the shoe 207 of lighting unit 110. The shoe 307 extends outward from the housing 302 and can be arranged to couple the housing 302 to the carrier 112. An advantage of the invention is that the overmolded housing 302 coupled to the carriers 112 provides support to ensure that the PCB 306 remains coupled to the carriers 112. In the event that the fastener 212 were to fail, the overmolded housing 302 would be able to provide support to maintain the positioning of the PCB 306 on the carrier 112. In the embodiment of FIGS. 3*a*-3*b*, each lighting units 300 comprises four shoes 307, two shoes formed at the area where the PCB 306 is coupled to the carrier 112. Since there are two carriers 112 used in the embodiments of FIGS. 3*a*-3*b* each lighting unit 300 comprises four shoes 307. However, the invention is not intended to be limited to four shoes. In other embodiments, the lighting units can comprise more or less than four shoes. The number of shoes formed could be based on many different factors, such as but not limited to the number of carriers used or the overmold used to form the housing.

In yet other embodiments, the lighting unit 300 does not comprise a housing. In such embodiments, the PCB 306 is coupled to the carrier 112 and is exposed in a manner similarly shown in FIG. 3*e*. In such embodiment without a housing, the lighting unit 300 can comprise a protective coating on at least part of the PCB 306, conductors 114, 116, crimp terminals 115 and/or center conductor 117 or a combination thereof, such that the light emitting elements 208 are exposed and the protective coating is not on the light emitting elements 208. The protective coating can be silicone based or any protective coating known in the art, and can be applied using many different methods known in the art.

The carrier 112 can be arranged in many different configurations. For example, the carrier can comprise a plurality of carrier holes 126, wherein the spacing between adjacent carrier holes is varied. This would allow a lighting unit to be mounted in different arrangements based on the configuration of the light box housing or the lighting solution. For example, the light box housing 102 of FIG. 1 has a rectangular shape with a plurality of linearly aligned arrays of lighting units 113; a carrier having holes whose spacing between adjacent carrier holes 126 is varied would allow the lighting units to be mounted on the carriers in non-linear or non-aligned configurations which could accommodate for irregularly shaped or custom shaped light box housings. In yet other embodiments, the carrier 112 can be arranged to comprise a plurality of linearly aligned carrier holes 126 that are spaced close together such that the spacing between adjacent lighting units 110 can be altered. Allowing the spacing between adjacent lighting units 110 to be adjusted provides flexibility in being able to control or adjust the light distribution pattern of the lighting units for a given lighting solution. This also allows for adjusting lighting units in the event that a hot spot or dark spot is present. In yet further embodiments, the carrier does not have any carrier holes 126, wherein a carrier hole can be formed at any location along the carrier or the fastener used to couple the PCB to the carrier is adapted to pierce the carrier when coupling the PCB to the carrier.

The carrier 112 can be formed of many different materials, such as but not limited to cotton, nylon, polyester, polypropylene or the like or a combination thereof. In some embodiments, the carrier can be a webbing formed of strong fabric woven as a flat strip or tube of varying width and fibers. In some embodiments, the carrier can be a multi-paneled webbing, similarly configured as automotive seat belts. An advantage of the invention is that the carrier provides a light weight and heavy duty material to receive the lighting units. Also, the carrier reduces costs related to manufacturing, shipping and installation. The carrier is flexible and pliable, such that the carrier can bend freely or repeatedly without breaking. The carrier can be bent in many different directions and does not become deformed or broken due to being bent. The carrier can be bent, twisted and/or folded and still be able to return to its original state, such as but not limited to a flat strip. The carrier is strong and durable such that the carrier can withstand the weight of the lighting units coupled to the carrier, thereby providing structural support to the lighting units mounted onto the carrier. Furthermore, the carrier can be mounted within a light box housing such that the carrier is taut and maintains the positioning of the lighting units within the light box housing.

Figure 4A:
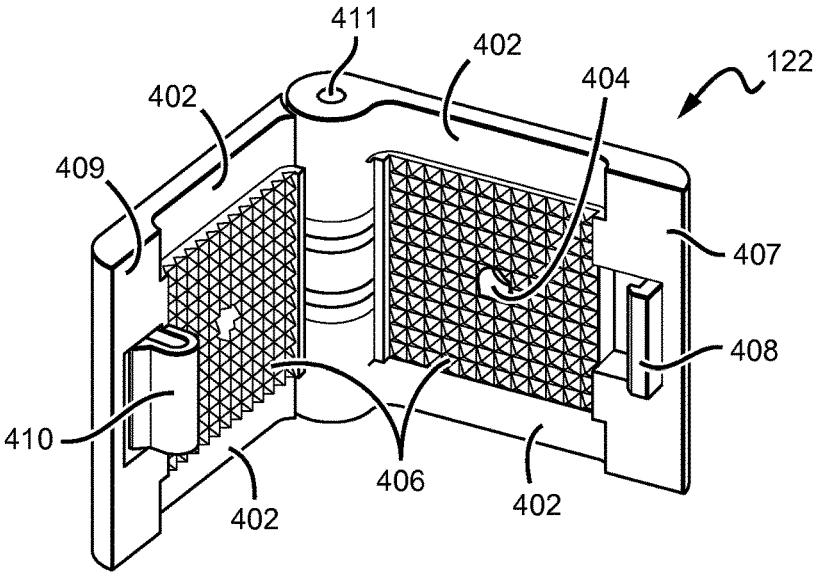
FIG. 4*a* is a perspective view of a clamp according to an embodiment of the invention.

FIGS. 4*a*-4*g* disclose how the array of lighting units can be mounted within the light box housing. FIG. 4*a* discloses a clamp 122 adapted to be coupled to an endpoint 120 of the array 113. The clamp 122 comprises a front plate 409, a back plate 407 and a hinge 411, wherein the front plate is hingedly connected to the back plate. The front plate is adapted to be received by the back plate such that the back plate holds the front plate and prevents the front plate from disengaging the back plate. In this arrangement, the clamp 122 could be considered as being closed. The back plate comprises a stop 408 extending from the back plate and the front plate comprises a tongue 410 extending from the front plate. The stop 408 is arranged to receive the tongue 410 when the front plate 409 is rotated about the hinge 411 and positioned adjacent the back plate 407. As the front plate 409 is positioned adjacent the back plate 407, the tongue 410 is slightly bent by the stop 408 as the stop receives the tongue. The front plate is received by the back plate when the tongue 410 has been fully received by the stop 408, such that the front plate is no longer able to be rotated about the hinge 411. The tongue 410 can be disengaged from the stop 408 by applying a force onto the tongue slightly bending the tongue and releasing the tongue from the stop 408.

The front and back plate further comprise at least one recess 402, at least one aperture 404, and a plurality of projections 406. The at least one recess 402 of the front and back plate are arranged to form a pocket 414 when the front plate is received by the back plate, or when the clamp 122 is closed. The pocket 414 is adapted to receive a shoe 207 of the lighting unit 110, to assist in holding the lighting unit. The at least one aperture 404 of the front and back plate are arranged to form a channel 412 when the front plate is received by the back plate, which is when the clamp is closed. The channel 412 is adapted to receive a bolt 424 in order to mount the array to the light box housing 102. The plurality of projections 406 can be arranged to have pointed tips, whereby the carrier 112 is placed on the clamp 122 and the clamp is closed, securing the carrier within the clamp. In such embodiment, the pointed tips of the front and back plate are arranged to contact the carrier 112 and hold the carrier in place. The pointed tips can be arranged to pierce the carrier 112 to further secure the carrier within the clamp 122. Furthermore, when the clamp 122 is closed, the clamp can apply a compression force onto the carrier 112 to further hold the carrier within the clamp. The invention is not intended to be limited to the plurality of projections comprising pointed tips, in other embodiments, the plurality of projections can be arranged to comprise a roughened surface or the like.

Figure 4B:
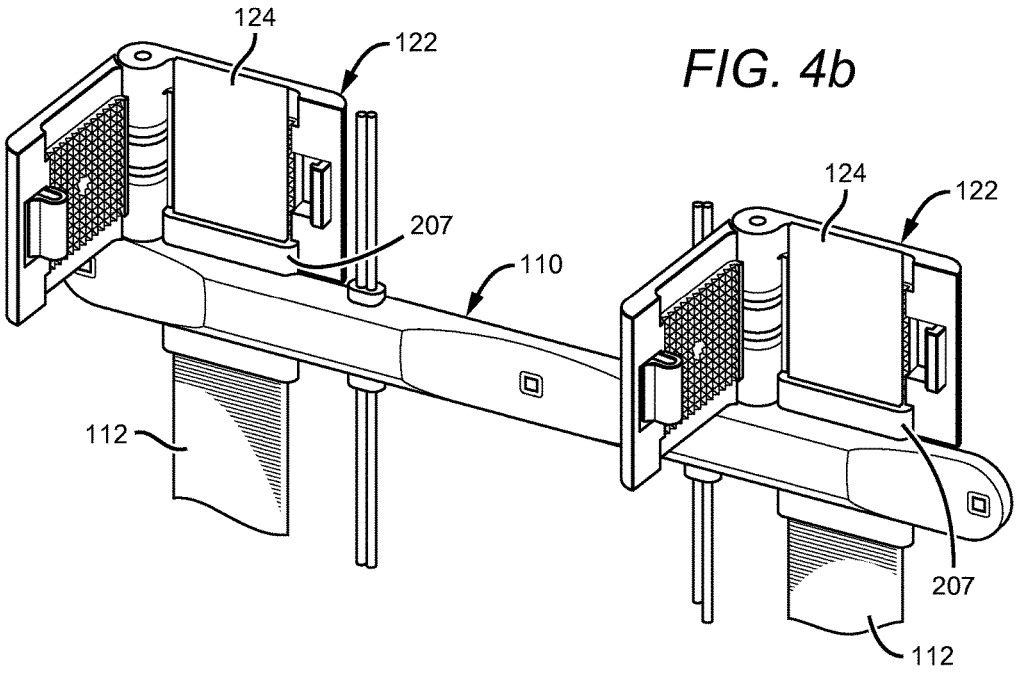
FIG. 4*b* is a perspective view of the clamp shown in FIG. 4*a*.
Figure 4C:
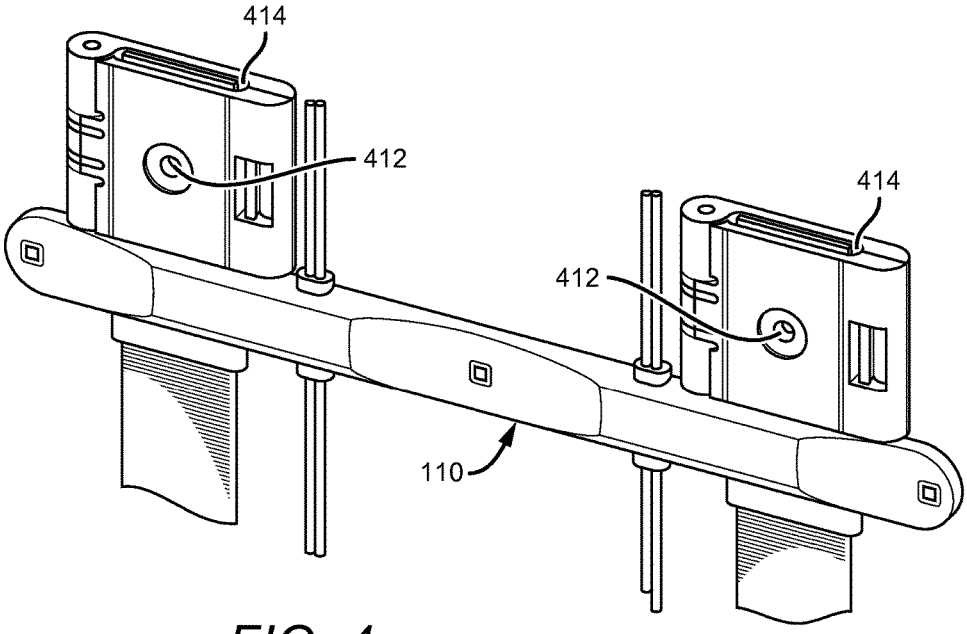
FIG. 4*c* is a perspective view of the clamp shown in FIG. 4*a*.

With reference to FIG. 4*b*, a respective end 124 of the carrier 112 is placed within a respective clamp 122, such that the shoe 207 of lighting unit 110 is placed within the recess 402 of the back plate 407. When the shoe 207 is properly seated within the recess 402, the clamp 122 can be closed, as seen in FIG. 4*c*. When the clamp 122 is closed, the recess 402 of the front plate 409 also receives the shoe 207, thereby forming a pocket 414 on opposing ends of the clamp, which is adapted to hold the shoe 207. In one embodiment, the pocket 414 applies a force onto the shoe 207 to assist in holding the lighting unit 110. With the clamp 122 closed, the apertures 404 of the front and back plate form the channel 412, which allows the array to be mounted to the light box housing. The light box housing 102 can comprise a mounting bracket 118 that is mounted within the light box housing and adapted to receive the array 113.

With reference to FIGS. 4*d*-4*g*, the mounting bracket 118 comprises a base 420 and at least one leg 416 extending from the base. The base 420 is arranged to be mounted to a sidewall 108 of the light box housing 102. The mounting bracket 118 can be mounted to the light box housing 102 by using screws, nails, pins, rivets or the like. The mounting bracket can be mounted to the light box housing a number of different means and is not intended to be limited to the embodiments disclosed herein. A pair of mounting brackets 118 are mounted onto opposing sidewalls 108 of the light box housing 102 and are aligned with each other in order to receive the array of lighting units 113. The mounting bracket 118 further comprises a perforation 418 on the leg 416. The perforation 418 is arranged to receive the bolt 424 in order to mount the clamp 122 to the mounting bracket 118. In one embodiment, the perforation 418 extends along part of the leg 416, such that the clamp 122 can be mounted to the mounting bracket 118 anywhere along the perforation. In other embodiments, the leg 416 comprises a plurality of perforations 418 wherein the clamp 122 can be mounted to the mounting bracket at points where one of the plurality of perforations is present. In yet other embodiments, the clamp can be mounted at any position on the leg of the mounting bracket. In the embodiment of FIGS. 4*d*-4*g*, the mounting bracket 118 comprises two legs 416. However, the invention is not intended to be limited to the mounting bracket having two legs. The mounting bracket can have one or more legs and can have one or more perforations. The mounting bracket can be arranged to comprise a leg for each carrier of the array, or can comprise only one leg adapted to receive any number of carriers used to form the array of lighting units.

Figure 4F:
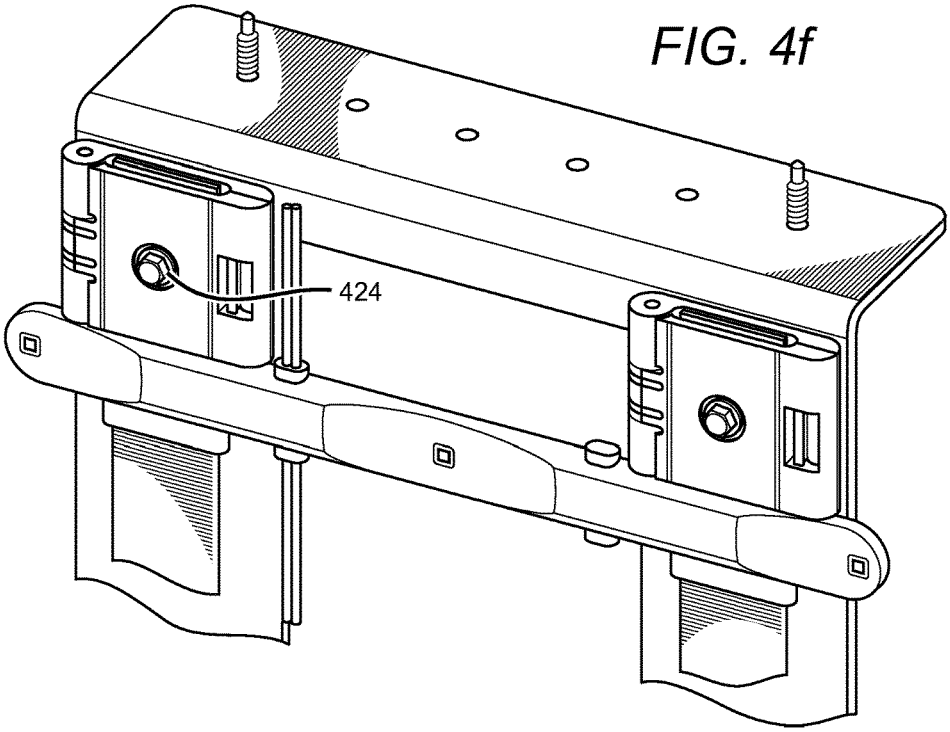
FIG. 4*f* is a perspective view of the clamp shown in FIG. 4*a* and the mounting bracket shown in FIG. 4*d*.
Figure 4G:
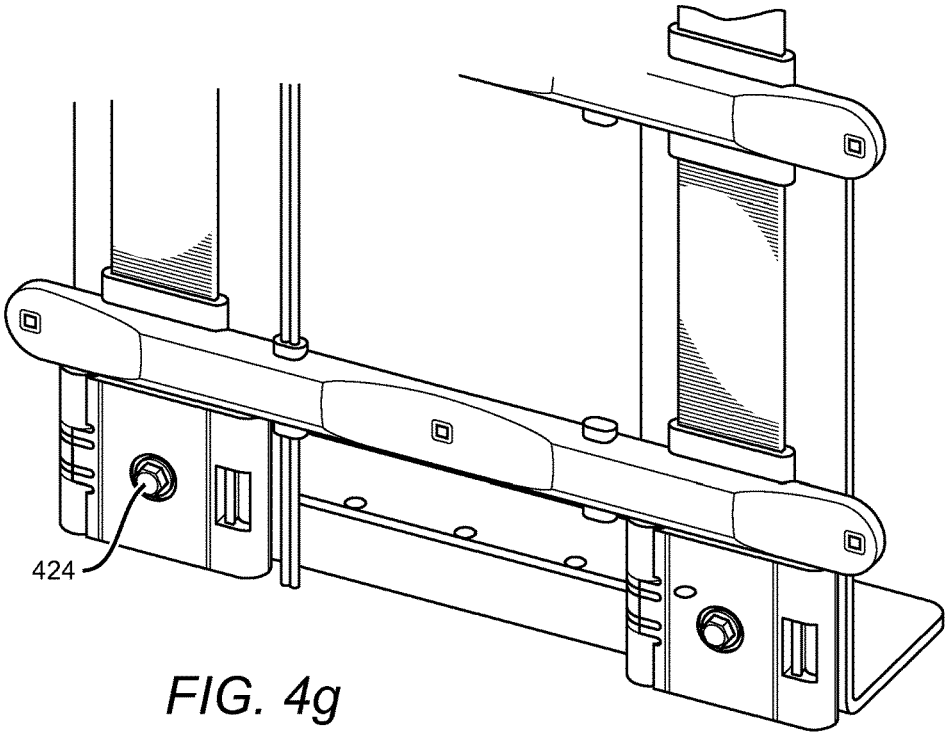
FIG. 4*g* is a perspective view of an additional clamp and mounting bracket according to an embodiment of the invention.

As seen in FIG. 4*e*, the endpoints 120 of the array are positioned on the mounting bracket 118 in order to mount the array to the light box housing 102. The ends 124 of the carrier 112 and the closed clamps 122 are placed on a respective leg 416 of the mounting bracket 118. Each channel 412 of the clamp 122 is aligned with a respective perforation 418 of each leg 416. The bolt 424 is then received by the channel 412 and the perforation 418 coupling each respective end 124 and clamp 122 to a respective leg 416 of the mounting bracket 118, as seen in FIG. 4*f*. FIG. 4*g* shows the other endpoint 120 of the array mounted to the opposing mounting bracket 118. Both endpoints 120 of the array are mounted in a similar manner. The perforation 418 is arranged to properly mount the array of lighting units 113 on the opposing brackets 118, due to the perforation being aligned with the channel 412 of each clamp 122. The perforation aligned with the channel ensures that the array is not misaligned. The bracket 118 does not affect the light emitted from the array of lighting units.

Figure 8A:
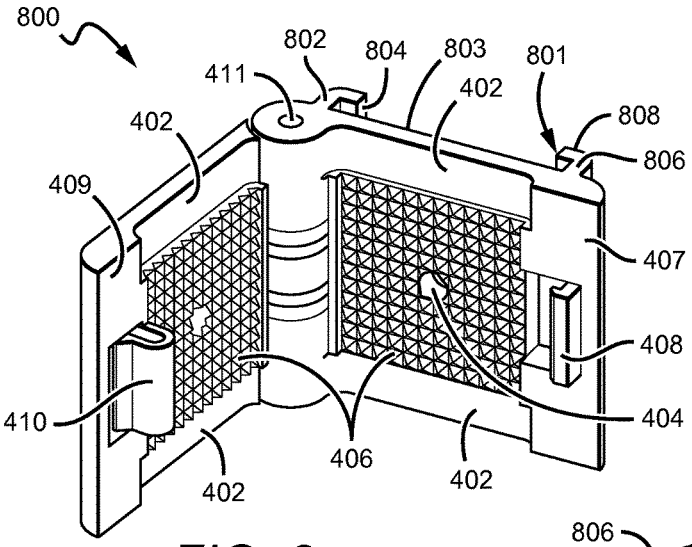
FIG. 8*a* is a perspective view of a clamp according to an embodiment of the invention.
Figure 8B:
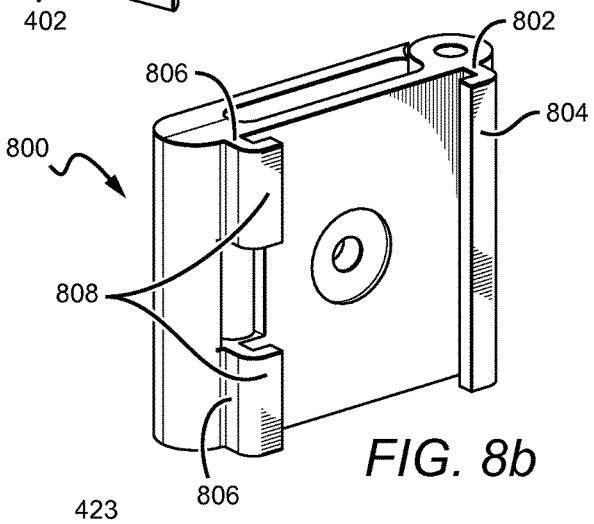
FIG. 8*b* is a rear view of the clamp shown in FIG. 8*a*.

The clamp can be configured in many different ways and is not intended to be limited to the embodiments disclosed herein. FIG. 8*a* discloses an embodiment of a clamp 800. Clamp 800 is configured similarly to clamp 122, discussed above, but further comprises a clamp bracket 801 on the back plate 407. The clamp bracket 801 comprises a first extension 802 extending from the back plate 407 and a first flange 804 extending from the first extension 802. Clamp bracket 801 further comprises a second extension 806 extending from the back plate 407 and a second flange 808 extending from the second extension 806. The clamp bracket 801 is on a back surface 803 of the back plate 407 opposite the plurality of projections 406 of the back plate 407. The first extension 802 is proximate the hinge 411 while the second extension 806 is proximate the stop 408. However, in other embodiment, the first and second extensions can be located at different positions on the back surface 803 and do not need to be proximate the hinge or stop. The first extension 802 and second extension 806 are arranged to extend along at least part of the back surface 803 of the back plate 407. In some embodiments, the first extension 802 or second extension 806 can extend along a substantial portion of the back surface 803. In other embodiments, the clamp bracket 801 can be comprised of a plurality of first extensions 802 or a plurality of second extensions 806 on the back surface 803 of the back plate 407. FIG. 8*b* discloses an embodiment of the clamp 800 wherein the clamp bracket 801 comprises a first extension 802 that extends along a substantial portion of the back surface 803 of the back plate 407, and comprises a plurality of second extensions 806 wherein each of the plurality of second extensions extends along part of the back surface 803 of the back plate 407. As further shown in FIG. 8*b*, each of the first and second extensions comprise a respective flange. The clamp bracket 801 can be configured in many different configurations and is not intended to be limited to the embodiments disclosed herein.

The first flange 804 extends from the first extension 802 towards the second flange 808. The second flange 808 extends from the second extension 806 towards the first flange 804. The first extension and flange 802, 804 and the second extension and flange 806, 808 form the clamp bracket 801. The first extension 802 and the second extension 806 are spaced apart from each other wherein the separation between the first and second extensions 802, 806 determines the dimensions of a mounting bracket to be utilized with the clamp bracket 801. The clamp bracket 801 is arranged to allow the clamp 800 to be slidably received by the mounting bracket or similar structure in order to mount the array of lighting units within the light box housing 102.

Figure 8E:
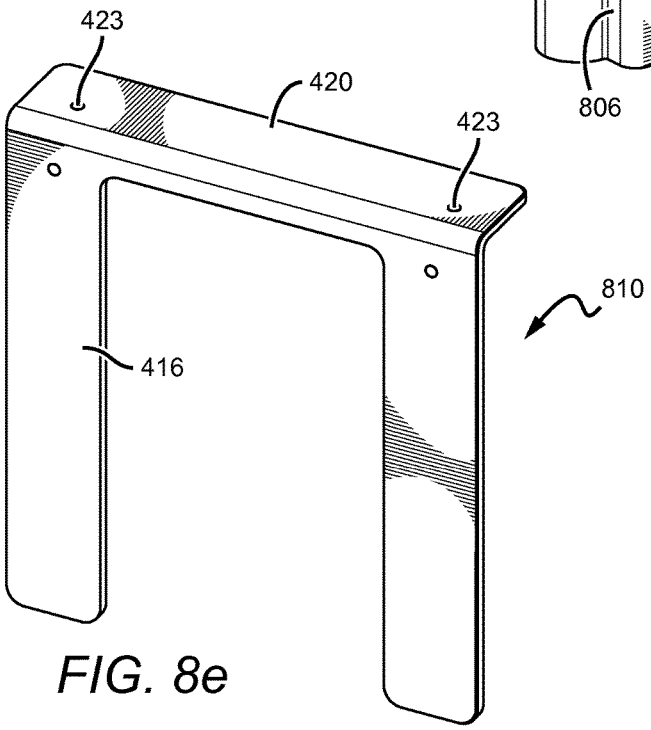
FIG. 8*e* is a perspective view of a mounting bracket according to an embodiment of the invention.
Figure 8C:
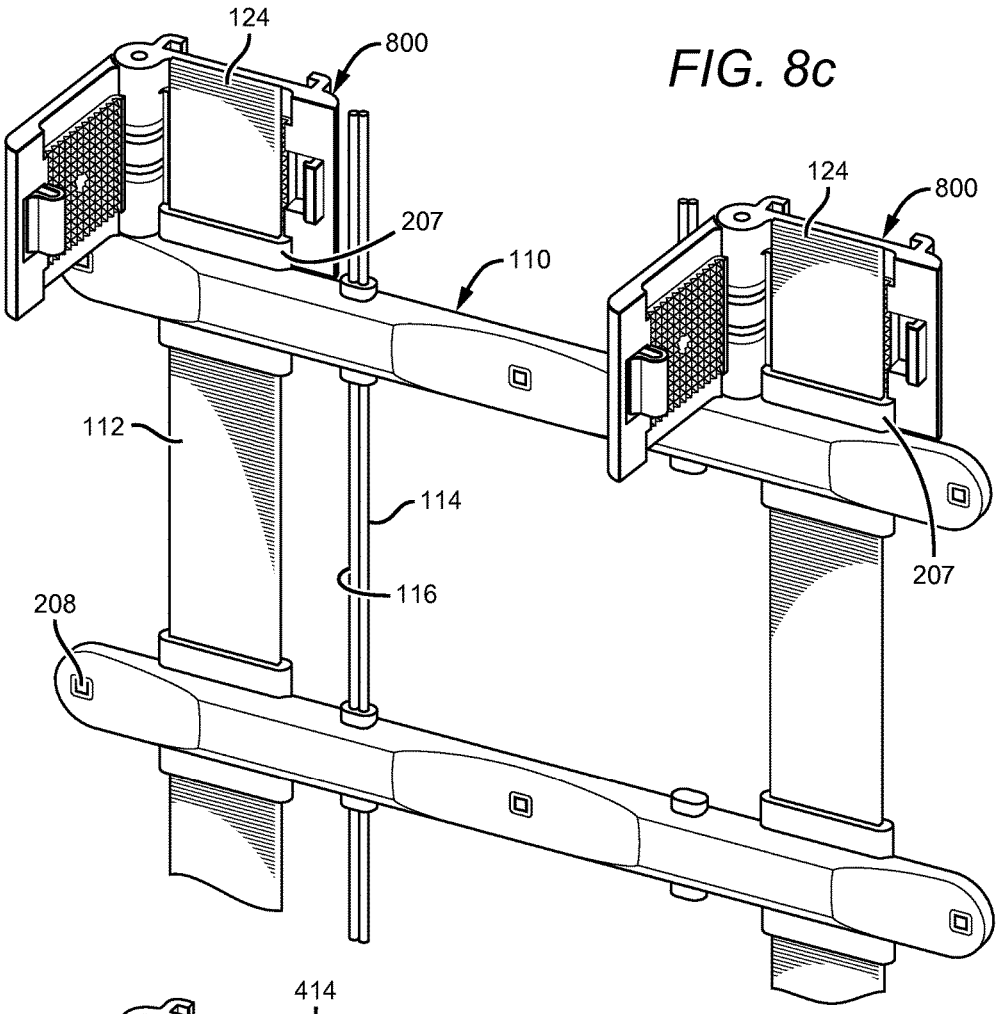
FIG. 8*c* is a perspective view of the clamp shown in FIG. 8*a*.
Figure 8D:
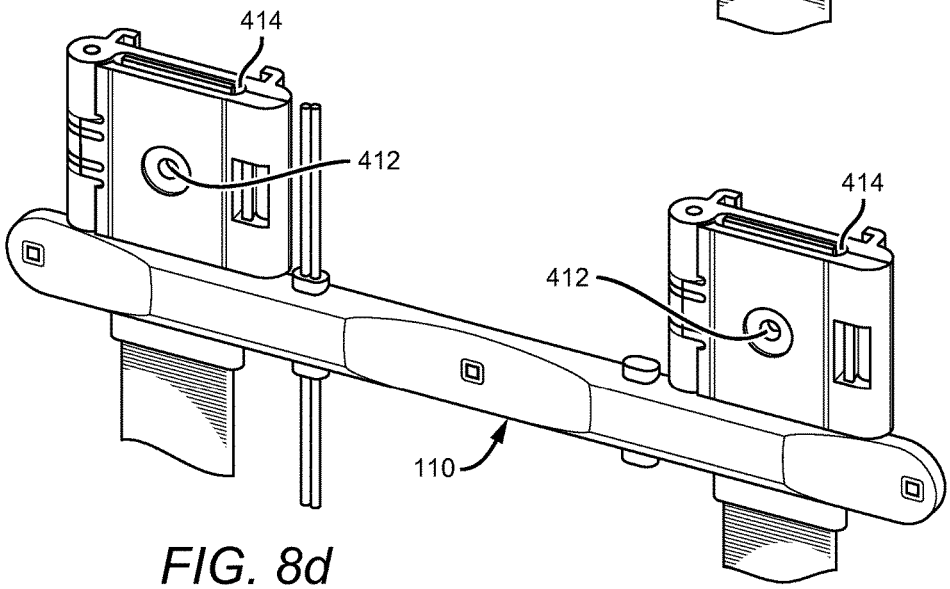
FIG. 8*d* is a perspective view of the clamp shown in FIG. 8*a*.

FIGS. 8*c*-8*f* disclose an array 113 of lighting units 110 mounted within the light box housing 102 using the clamp 800. The clamp 800 is adapted to be coupled to an endpoint 120 of the array 113 in a manner similar to the clamp 122, discussed above. With reference to FIGS. 8*c* and 8*d*, a respective end 124 of the carrier 112 is placed within a respective clamp 800, such that the shoe 207 of the lighting unit 110 is placed within the recess 402 of the back plate 407. When the shoe 207 is properly seated within the recess 402, the clamp 800 can be closed, as seen in FIG. 8*d*. When the clamp 800 is closed, the recess 402 of the front plate 409 also receives the shoe 207 of the lighting unit 110, thereby forming a pocket 414 on opposing ends of the clamp 800. The pocket 414 is adapted to hold the shoe 207. In one embodiment, the pocket 414 is shaped to correspond to the shape of the shoe 207 such that the shoe 207 is tightly held by the pocket and is arranged to apply a force onto the shoe 207 to assist in holding the lighting unit 110. In other embodiments, the pocket 414 is arranged to receive the shoe 207 but does not necessarily apply a force onto the shoe 207. With the clamp 800 closed, the apertures 404 of the front and back plate form the channel 412. As stated above, the channel 412 is adapted to receive a bolt 424 in order to mount the array 113 to the light box housing 102. Other fastening devices, such as but not limited to screws, nails, pins, rivets, or the like, can be used instead of a bolt, and the invention is not intended to be limited to a bolt.

Figure 8F:
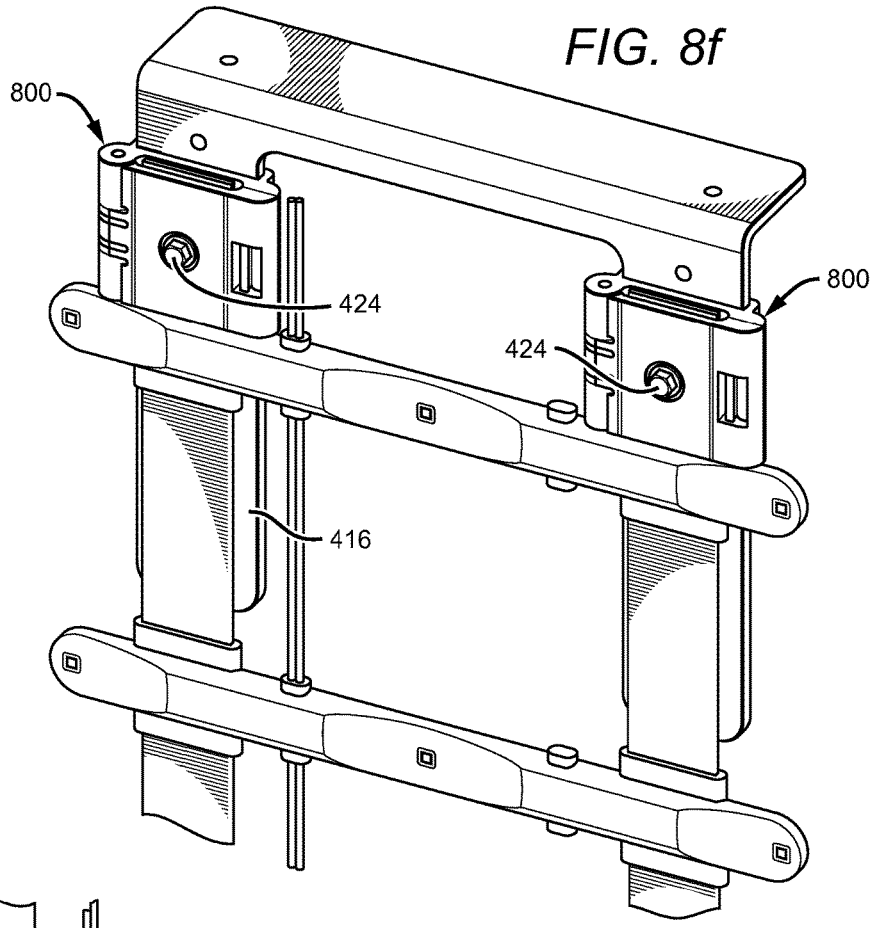
FIG. 8*f* is a perspective view of the clamp shown in FIG. 8*a* and the mounting bracket shown in FIG. 8*e*.

The mounting bracket 810 in FIGS. 8*e* and 8*f* is similar to the mounting bracket 118 discussed above and can be mounted to the light box housing 102 in a similar manner as mounting bracket 118. The mounting bracket 810 comprises a base 420 and at least one leg 416. The mounting bracket 810 in FIGS. 8*e* and 8*f* comprises two legs 416, but the mounting bracket 810 is not intended to be limited to only two legs 416. In other embodiments, the mounting bracket 810 can have one or a plurality of legs 416. In one embodiment of the invention, a pair of mounting brackets 810 are mounted onto opposing sidewalls 108 of the light box housing 102 and are aligned with each other in order to receive the array 113 of lighting units. The mounting bracket 810 can comprise a perforation 418 on the leg 416. The perforation is arranged to receive the bolt 424 to mount the clamp 800 and the respective end 124 of the carrier 112 to the mounting bracket 810. In one embodiment, the perforation 418 extends along part of the leg 416, such that the clamp 800 can be mounted to the mounting bracket 810 anywhere along the perforation. In other embodiments, the leg 416 comprises a plurality of perforations 418 wherein the clamp 800 can be mounted to the mounting bracket 810 at points where one of the plurality of perforations 418 is present. In yet other embodiments, the clamp 800 can be mounted to the mounting bracket 810 at any point of the leg 416. In such embodiment, the bolt 424 can be arranged to exert force onto the leg 416 to mount the clamp 800, or the bolt 424 can be arranged to pierce the leg 416 to mount the clamp 800.

As seen in FIG. 8*f*, the endpoints 120 of the array 113 are positioned on the mounting bracket 810 in order to mount the array 113 to the light box housing 102. The ends 124 of the carrier 112 and the closed clamp 800 are placed on a respective leg 416 of the mounting bracket 810. The clamp 800 is arranged to be slidably received by the respective leg 416 due to the clamp bracket 801. The separation between the first and second extension 802, 806 determines the dimensions of the leg 416 of the mounting bracket 810 that can be used with the clamp 800. To mount the endpoints 120 of the array 113 to the mounting bracket 810, a respective clamp 800 is slid onto a respective leg 416 of the mounting bracket 810. Once the clamps 800 are positioned on the desired mounting location on the leg 416, the bolt 424 can be inserted into the channel 412 of the clamp 800 to mount the ends 124 of the array 113 to the respective leg 416 of the mounting bracket 810, as seen in FIG. 8*g*. The other endpoint 120 of the array 113 can be mounted to the opposing mounting bracket 810 in a similar fashion as discussed above. Both endpoints 120 of the array 113 are mounted in a similar manner.

In the embodiment of FIGS. 8*a*-8*f*, the array 113 of lighting units is comprised of lighting units 110, which are arranged to have lighting emitting elements 208 on only one side. In other embodiments, the array 113 can be comprised of lighting units 300 and can be mounted to the light box housing 102 similarly as the array 113 of lighting units 110. In yet other embodiments, the lighting units 110, 300 do not comprise a housing such that the PCB is uncovered, as discussed above.

At least one advantage of the invention is that the clamp assists in properly aligning the array 113 on the mounting bracket. For example, in the embodiment disclosed in FIGS. 8*a*-8*f*, the clamps 800 are attached to a respective endpoint 120 of the array 113, wherein a respective shoe of the lighting unit is within the pocket of the respective clamp 800. In this configuration, the clamps 800 are arranged such that both clamps 800 are simultaneously slidably received by a respective leg 416 of the mounting bracket 810 via the clamp bracket 801. Simultaneously sliding the clamps 800 onto the respective leg 416 ensures that each endpoint 120 of the array 113 is properly aligned on the mounting bracket 810, such that the array 113 can be properly received and mounted onto the opposing mounting brackets 810. The clamps 800 having the mounting bracket 810 also prevents the clamps 800 and endpoints 120 from being misaligned on the leg because sliding one clamp 800 results in the other clamp 800 being slid accordingly, such that both clamps 800 are slid along their respective leg accordingly, thereby preventing one clamp 800 to be moved while the other clamp 800 is not moved. Misalignment of the endpoint 120 of the array on the mounting bracket could result in the array not being properly aligned in the light box housing, which could affect the light radiation pattern within the light box housing creating hot spots and/or dark spots. Additionally, misalignment can prevent the opposing endpoint of the array from being mountable onto the opposing mounting bracket, which would require the removal and remounting of the first endpoint of the array.

In the embodiment of FIGS. 8*a*-8*f*, the clamps 800 are arranged to be substantially aligned with each other. However, in other embodiments, the clamps 800 do not have to be substantially aligned with each other. In some embodiments, the clamps 800 can be arranged on a respective portion of the carrier 112 such that the clamps 800 are not substantially aligned with each other. However, the clamps 800 are still arranged to be slidably received by a respective leg 416, but do not need to be received at the same time, such that one clamp 800 may be received by the leg 416 before the other clamp 800 is received on its respective leg 416. In such embodiment, the clamps 800 would still slide along the respective leg 416 in a similar manner as discussed above.

Yet another advantage of the invention is that carrier 112 allows for the array 113 to be easily mounted within the light box housing 102. For example, the array can be easily mounted onto the opposing mounting brackets 810 due to the properties of the carrier 112. In the embodiment of FIGS. 8*a*-8*f*, a first endpoint 120 of the array 113 is mounted to the mounting bracket 810, which is mounted to the light box housing, by sliding the clamps 800 onto a respective leg 416 of the mounting bracket 810. The second opposing endpoint 120 of the array 113 is subsequently mounted to the opposing mounting bracket 810, which is mounted to the light box housing, by sliding the clamps 800 onto a respective leg 416 of the opposing mounting bracket 810. The legs 416 of the mounting brackets 810 extend a distance from the base 410 of the mounting bracket 810, such that when mounting the clamps 800 onto the legs 416 of the opposing mounting brackets 810, the array 113 is adapted to be bent so that the clamps 800 can be slidably received by the legs 416 of the opposing mounting bracket 810. The array 113 is bendable due to the physical properties of the carrier 112. As stated above, the carrier can be bent, twisted and/or folded and still be able to return to its original state. The pliability of the carrier allows the array to be bent, twisted and/or folded in order to slide the clamps 800 onto the legs 416 of the mounting bracket 810. Such arrangement would not be possible with a rigid carrier, such as a carrier made of metal or the like. Bending and/or twisting a rigid carrier would result in a distorted carrier such that the rigid carrier would be unusable because the rigid carrier would not be able to return to its original state. The ability to bend the array allows the mounting brackets to be mounted within the light box housing first and without the array being mounted on the mounting brackets. However, the carrier also provides the option of being able to mount the array to the mounting brackets prior to mounting the mounting brackets to the light box housing. Mounting the mounting brackets without the array eases the installation of the mounting brackets within the light box housing because the array will not potentially interfere with the mounting of the mounting brackets within the light box housing, especially in instances where a plurality of arrays are mounted within a light box housing. However, in instances where the array is mounted to the mounting brackets prior to mounting the mounting brackets to the light box housing, the carrier allows any of the arrays to be moved aside to allow access to the light box housing when installing any of the arrays. The ability to mount the respective mounting brackets to the light box housing without the respective one of a plurality of arrays significantly increases the ease of installation because adjacent arrays will not be an obstacle and/or hindrance when installing other mounting brackets.

In the embodiment of FIGS. 4*a*-4*g* and 8*a*-8*f*, the array 113 of lighting units is comprised of lighting units 110, which are arranged to have light emitting elements 208 on only one side. In other embodiments, the array 113 can be comprised of lighting units 300 and can also be mounted to the light box housing similarly as described in FIGS. 4*a*-4*g* and 8*a*-8*f*. Figures directed to embodiments of mounting an array comprised of lighting units 300 are not included herein in an effort to reduce multiplicity of duplicate figures.

Figure 5C:
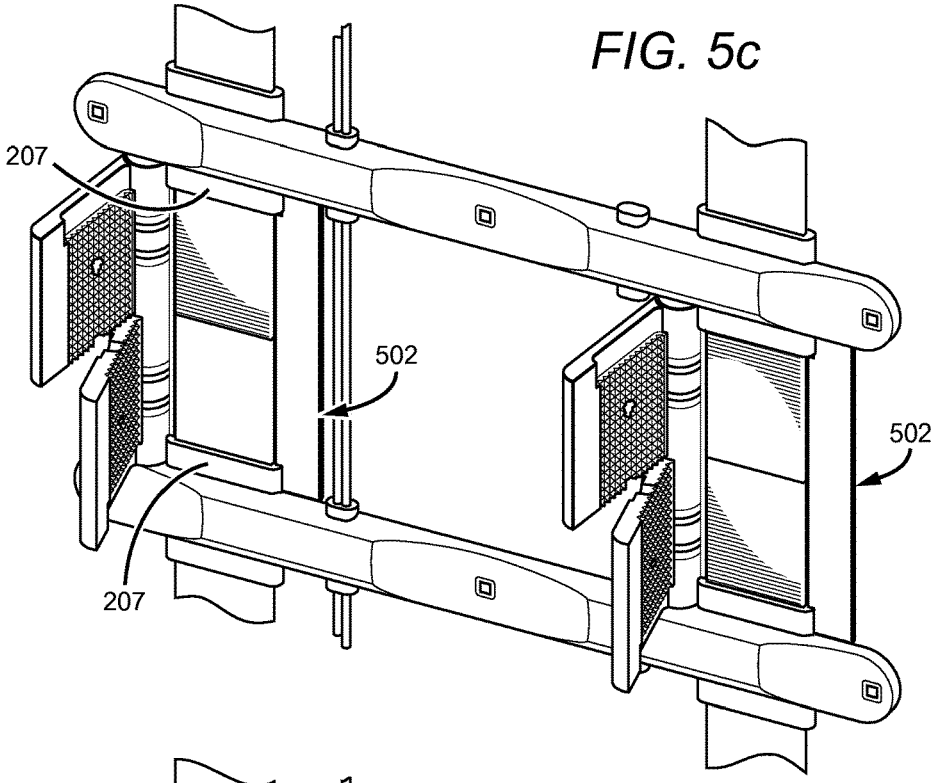
FIG. 5*c* is a perspective view of the array of lighting units shown in FIG. 5*a*.

FIGS. 5*a*-5*e* disclose an embodiment of the invention wherein a carrier 112 is coupled to another carrier 112. As seen in FIG. 5*a*, the respective ends 124 of the carrier 112 are aligned. In some embodiments, at least one carrier 112 may need to be trimmed in order to be aligned with the other end 124 of the other carrier 112. FIG. 5*b* discloses a coupler 502 that is adapted to couple the two ends 124 of the two carriers 112. The coupler 502 is configured somewhat similar to the clamp 122. However, the coupler 502 comprises a back plate 508, a plurality of front plates 510 and a hinge 512, wherein each of the plurality of front plates are hingedly connected to the back plate. The front and back plates further comprise at least one recess 504, and a plurality of projections 516. The at least one recess 504 of the front and back plates are arranged to form a pocket (not shown), similar to pocket 414, when the front plates are positioned to be adjacent the back plate 508, which is when the coupler 502 is closed. The pocket is adapted to receive the shoe 207, 307 which can assist in holding the lighting unit. Each of the front plates comprise an aperture 506 arranged to receive a pin 517 in order to assist in holding the carrier within the coupler 502. The plurality of projections 516, similarly arranged to projections 406, can be arranged to have pointed tips, whereby the carrier 112 is placed on the coupler 502 and the coupler is closed, securing the carrier within the coupler. In such embodiment, the pointed tips of the front and back plates are, arranged to contact the carrier 112 and hold the carrier in place. The pointed tips can be arranged to pierce the carrier 112 to further secure the carrier within the coupler 502. Furthermore, when the coupler 502 is closed, the coupler can apply a compression force onto the carrier 112 to further hold the carrier within the coupler. The invention is not intended to be limited to the plurality of projections comprising pointed tips, in other embodiments, the plurality of projections can be arranged to comprise a roughened surface or the like.

Figure 5D:
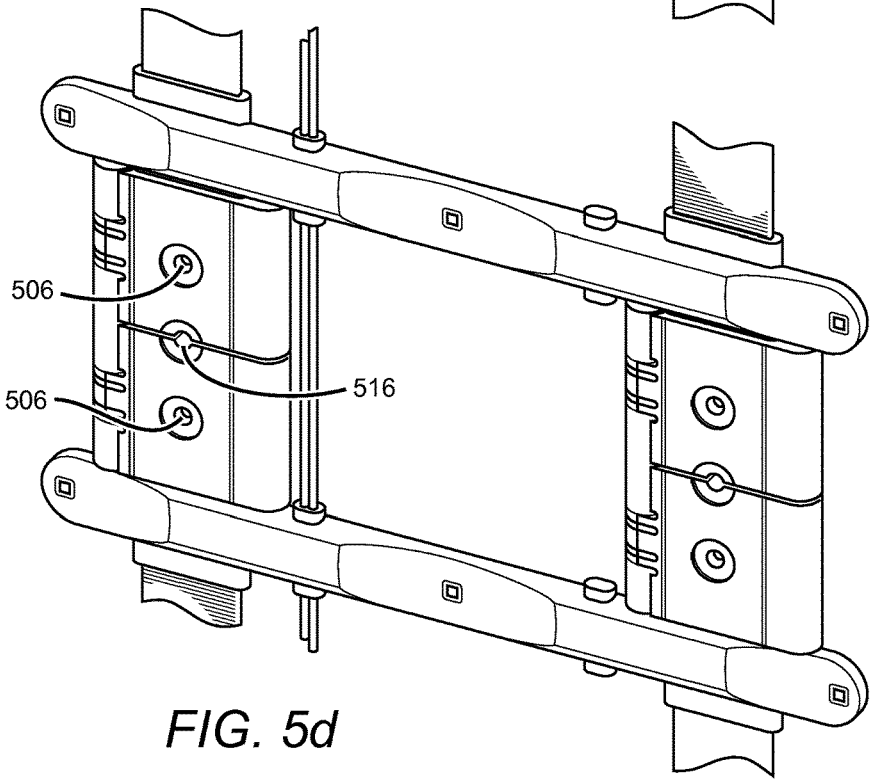
FIG. 5*d* is a perspective view of the array of lighting units shown in FIG. 5*a*.
Figure 5E:
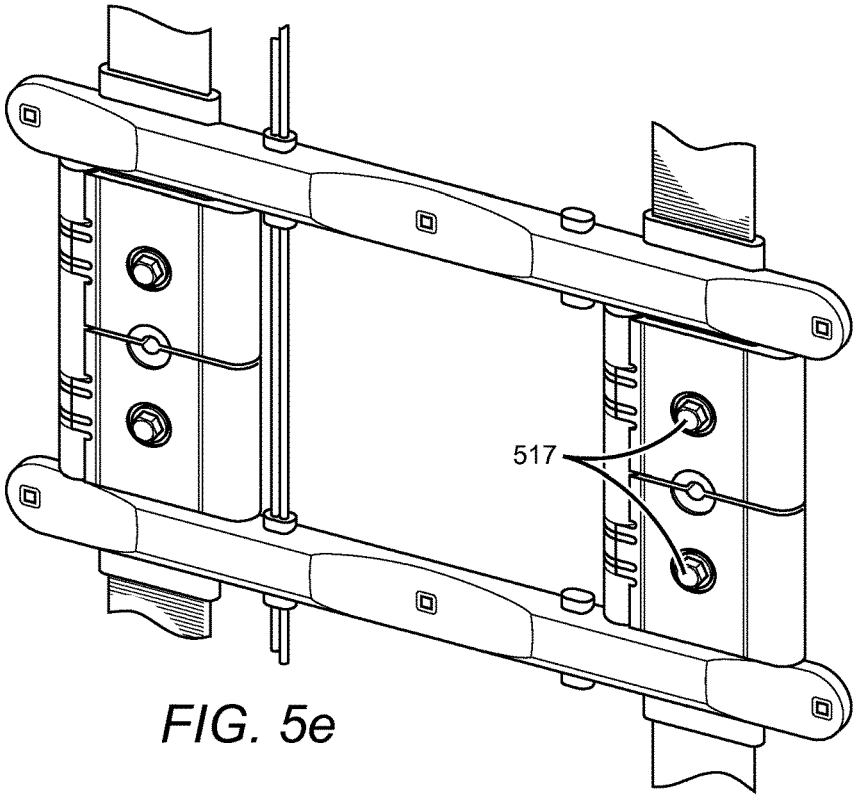
FIG. 5*e* is a perspective view of the array of lighting units shown in FIG. 5*a*.

With reference to FIG. 5*c*, the respective ends 124 of the carriers 112 are placed within a respective coupler 502, such that the shoe 207, 307 of the lighting unit 110, 300 is placed within the recess 504 of the back plate 508. When the shoe 207, 307 is properly seated within the recess 504, the coupler 502 can be closed, as seen in FIG. 5*d*. When the coupler 502 is closed, the recess 504 of the front plates 510 also receive the shoe 207, 307, thereby forming a pocket (not shown) which holds the shoe 207, 307. In one embodiment, the pocket applies a force onto the shoe to assist in holding the lighting unit, while in other embodiments, the pocket does not necessarily apply a force onto the shoe. With the coupler 502 closed, the apertures 506 of the front plates 510 are arranged to receive a pin 517. The pin 517 applies a force onto the ends 124 of the carriers 112 in order to couple the carriers 112 to the coupler 502. The pin 517 also applies a force onto a respective front plate 510, such that the front plate applies a compression force onto the carriers 112 to further hold the carrier within the coupler 502. In some embodiments, the pin 517 can be arranged to pierce the carrier 112 to couple it to the coupler, while in other embodiments, the pin 517 does not pierce the carrier but applies a force onto the carrier to couple the carrier to the coupler.

The coupler 502 can be arranged in many configurations and is not intended to be limited to the embodiments disclosed herein. In one embodiment, each of the front plates can further comprise an indentation 514 and the back plate can further comprise an opening 503, such that the indentations and opening are arranged to form a groove 516 when the coupler 502 is closed. The groove 516 is adapted to receive a bolt 424 (not shown) in order to mount the coupler 502 to a light box housing or similar structure. In yet other embodiments, the back plate can comprise an aperture 506 aligned with a respective aperture 506 of each of the front plates 510, such that the apertures 506 of the front plates 510 and the back plate 508 form a channel when the coupler 502 is closed. The channel is adapted to receive a bolt 424, wherein the bolt is arranged to pierce the carrier 112 and be received by the aperture of the back plate 508. In yet other embodiments, the ends 124 of the carriers 112 can be arranged to comprise a hole arranged with the channel to receive the bolt 424 in order to couple the carriers to the coupler.

Figure 9A:
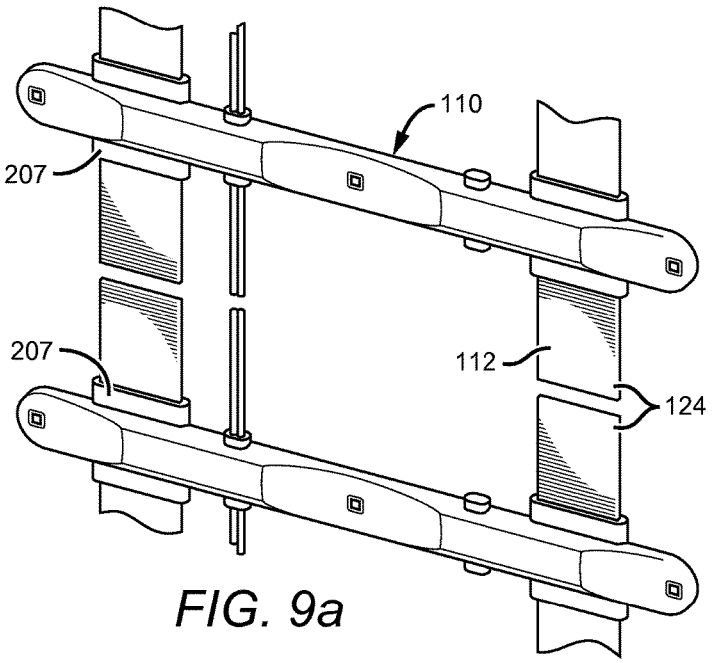
FIG. 9*a* is a perspective view of an array of lighting units according to an embodiment of the invention.
Figure 9D:
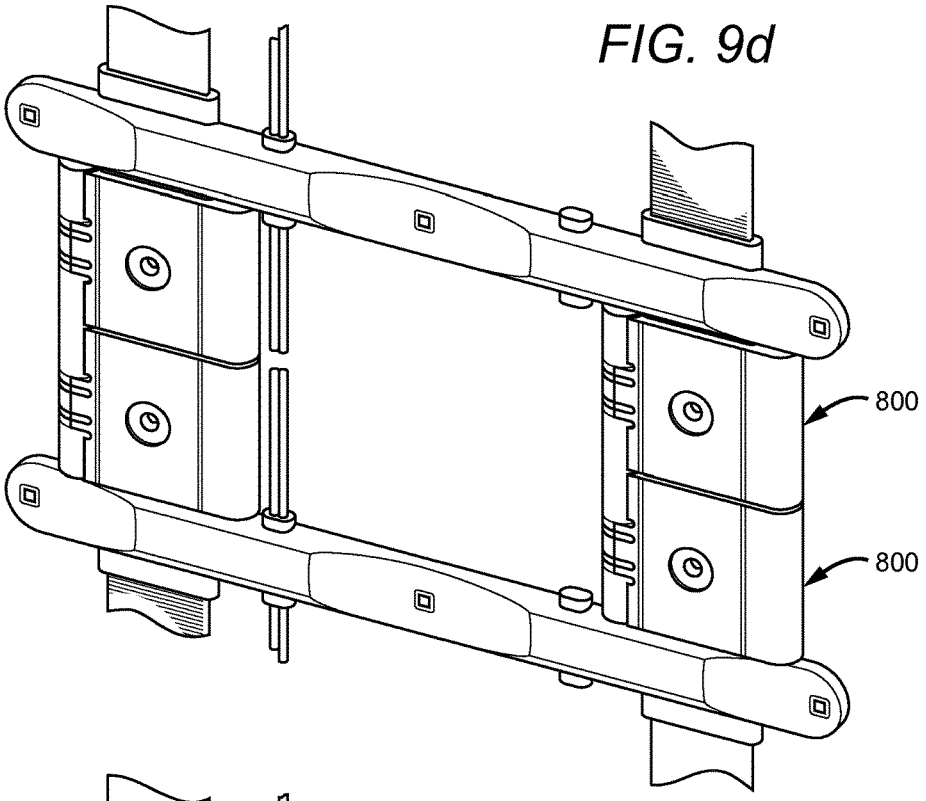
FIG. 9*d* is a perspective view of the array of lighting units shown in FIG. 9*a*.

FIGS. 9*a*-9*f* disclose another embodiment of the invention wherein the carrier 112 can be coupled to another carrier 112. FIGS. 9*b* and 9*c* disclose an embodiment of a coupler 902 that is similar to and operates in a manner similar to coupler 502 discussed above, but is arranged to comprise a plurality of clamps 800. The clamps 800 of the coupler 902 are similar to the clamps 800 discussed above and shown in FIGS. 8*a*-8*b*. With reference to FIG. 9*d*, the ends 124 of the carrier 112 of a first array 904 are aligned with respective opposing ends 124 of a carrier 112 of a second array 906. In some embodiments, one or more ends 124 of the carrier 112 of the first and/or second array 904, 906 can be trimmed in order to align respective opposing ends 124 of the arrays. A clamp 800 is coupled to the first carrier 112 of the first array 904 proximate a cut portion of the first carrier 112, such that the shoe 207 of the lighting unit 110 is within the pocket 414 of the clamp 800. A second clamp 800 is coupled to the second carrier 112 of the second array 906 proximate a cut portion of the second carrier, such that the shoe is within the pocket of the clamp. In this arrangement, the clamps 800 could be considered as being closed, similarly as discussed above.

Upon the closure of the clamps 800 on the respective carrier 112, the clamps 800 are arranged to be adjacent each other and arranged to receive a clamp connector 908. In the embodiment of FIG. 9*d*, the clamps 800 are arranged to abut each other, such that the clamps 800 are contacting each other. However, in other embodiments, the clamps 800 do not have to abut each other and can have space in between the clamps. The coupler 902 further comprises the clamp connector 908 which is arranged to be slidably received by the clamp bracket 801 of each of the clamps 800 of the coupler 902, wherein a respective bolt 424 can be received by a respective channel 412 of each clamp 800 in order to couple the first and second arrays 904, 906. The clamp connector 908 is shaped to fit within the clamp bracket 801 of each of the respective clamps 800, and does not interfere with the light emission and/or the light radiation pattern of the lighting units, as shown in FIG. 9*f*. The clamp connector 908 is arranged to assist in maintaining the positioning of the clamp 800 in a closed position on the carrier, so that the coupled arrays do not become uncoupled. The clamp connector 908 can be made of many different materials, such as, but not limited to, metal, plastic, wood, combination thereof, or the like. The bolt 424 that is received by the channel 412 of each clamp can be arranged to pierce the carrier and the clamp connector 908, as shown in FIG. 9*f*, in order to properly secure the clamps and carriers. In other embodiments, the bolt can pierce the carrier but not the clamp connector, such that the bolt applies a force onto the clamp connector to secure the clamp and carrier. The carrier can be arranged to comprise a plurality of holes, such that the bolt extends through one of the holes of the carrier. While in other embodiments, the bolt pierces the carrier and creates a hole in the carrier.

Figure 9E:
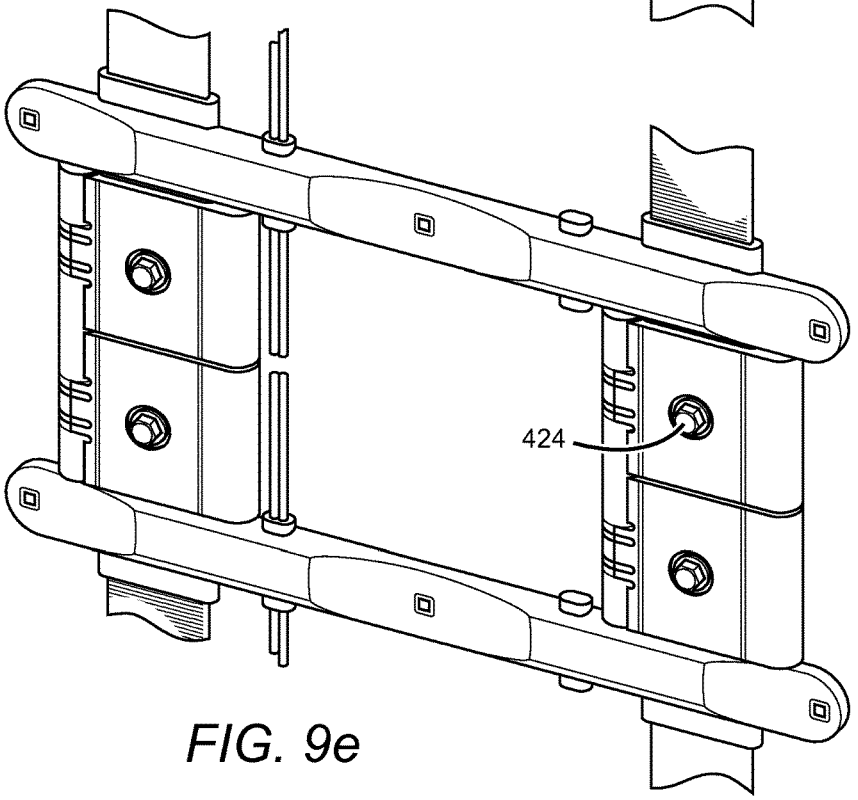
FIG. 9*e* is a perspective view of the array of lighting units shown in FIG. 9*a*.

In the embodiment of FIGS. 5*c* and 9*e*, the cut portions of the carriers are shown as being adjacent to each other and almost in contact with each other. In other embodiments, the cut portions of the carriers are not in contact with each other and can be spaced apart. In such instances, the carriers might not be long enough to provide a sufficient surface area to be fully received by the coupler and/or received by the bolt. The length of the carrier extends a distance from the shoe of the lighting unit towards the cut portion of the carrier. However, if the length of the carrier does not provide sufficient length to provide a surface area to allow the carrier to be coupled to the coupler and/or bolt, then the array could be supported by the shoe of the lighting unit being held by the pocket of the coupler. In some embodiments, the pocket can be arranged to provide support by holding the shoe regardless of the length of the carrier.

At least one advantage of the invention is that the coupler 502, 902 is arranged to assist in properly spacing the lighting units of the first and second arrays that are adjacent the coupler. The couplers 502, 902 are arranged to separate the lighting units adjacent the couplers a distance substantially similar as the other lighting units of the array. The coupler ensures that the emitted light from the combined array is uniform and does not produce any hot spots and/or dark spots. For example, with reference to FIG. 9*e*, the couplers 902 when coupled to the carriers separate the lighting units a distance substantially similar to the other lighting units. In the embodiment shown in FIGS. 9*b*-9*f*, the coupler 902 is comprised of two clamps 800, but the invention is not intended to be limited to the coupler comprising two clamps. In other embodiments, the coupler 902 can be comprised of one clamp 800 or a plurality of clamps 800. Yet another advantage of the invention is that the bolt 424 received by the coupler can also be used to mount the array to a light box housing or similar structure.

Lighting units according to the present invention can also comprise other elements, with one embodiment comprising heat sinks to dissipate heat from the light emitting elements. In another embodiment, the lighting units can comprise a power supply (not shown) electrically connected to conductors 114, 116. Power supplies are generally known in the art and are only discussed briefly herein. In one embodiment, the power supply is adapted to provide a constant current output. The power supply provides substantially the same drive current to the light emitting elements 208 so that the lighting unit can emit a substantially constant light distribution pattern in accordance with the desired light emission. In some embodiments, the power supply can be installed remote to the lighting unit, whereas in other embodiments, the power supply can be mounted on or within the light box housing. At least one advantage of the invention is that the power supply, while in operation, allows the plurality of lighting units to provide and maintain the desired light output and prevents the lighting system from exhibiting an undesirable light output, such as but not limited to different levels of light brightness, color variations or variations in the light distribution pattern. In yet other embodiments, the lighting unit can comprise constant current drive circuitry electrically connected to the power supply in order to provide the same drive current to the light emitting elements.

The array of lighting units may be mounted proximate to the back 106 of the light box housing or in between the light transmissive face and back 104, 106 of the light box housing 102 when the light box housing has output surfaces on both of the face and back. The array of lighting units can be installed in existing light box housings as a retrofit kit unit such that the array of lighting units replaces conventional light sources. An advantage of the mounting bracket is that the mounting bracket can be positioned over existing light bulb sockets of existing light box housings which allows the positioning of the array of lighting units to correspond with the position of the replaced conventional light.

Figure 12B:
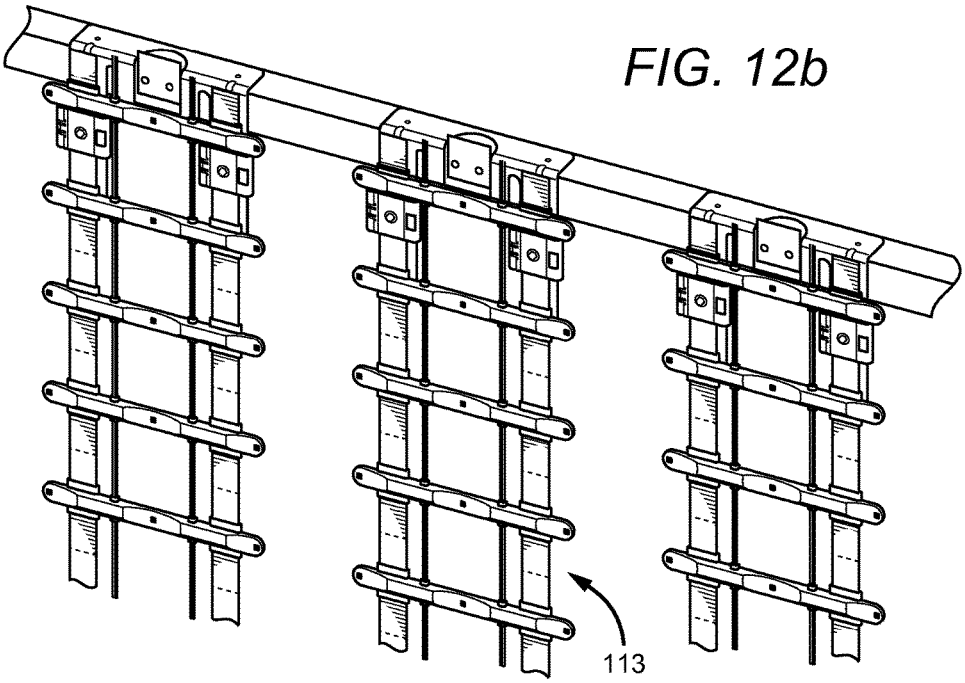
FIG. 12*b* is a perspective view of the array of lighting units shown in FIG. 12*a*.
Figure 12C:
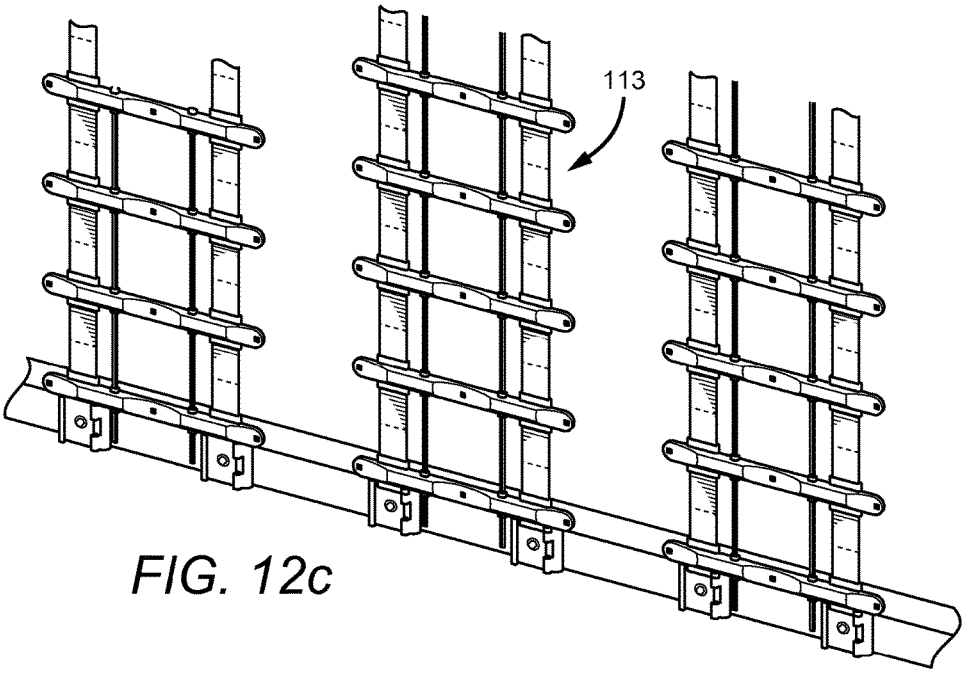
FIG. 12*c* is a perspective view of the array of lighting units shown in FIG. 12*a*.

The array of lighting units can be mounted to the light box housing in many different ways and is not intended to be limited to the embodiments disclosed herein. In one embodiment, as in FIGS. 12*a-c*, at least one array 113 of lighting units can be mounted to a cross bar 1202 that is external to the light box housing, such that the cross bar 1202 comprising the mounted at least one array can be mounted within the light box housing 102. Mounting the at least one array 113 to the cross bar 1202 allows for the ease of installation of the array within the light box housing. In the embodiment of FIGS. 12*a-c*, the cross bar 1202 comprises a plurality of arrays 113, and mounting the plurality of arrays 113 to the cross bar 1202 allows the plurality of arrays to be quickly and easily installed within the light box housing by mounting the cross bar 1202 within the light box housing. Such arrangement allows the arrays to be mounted on the cross bar in a setting that is external to the light box housing and free of any obstacles and/or accessibility constraints, whereby mounting the cross bar to the light box housing results in the mounting of the plurality of arrays within the light box housing at the same time. This allows for the installation of the plurality of arrays to be easier, especially if spacing and/or accessibility is limited. In some embodiments where the light box housing is elevated off the ground, access to the light box housing is limited and could require a ladder, lift or similar structure. In such instances, the cross bar having one or more arrays mounted to it would allow the one or more arrays to be easily and simultaneously installed by using a pole, elongated structure, or the like to lift the cross bar and place it within the light box housing, such that an installer would only need to climb the ladder once or operate the lift a minimum number of times in order to mount the plurality of arrays within the light box housing. Yet another advantage would be if the arrays would need to be serviced, which would only require the bottom part of the arrays to be disconnected from the housing and remove the arrays by removing the cross bar from the light box housing. The cross bar reduces the time it would take to install and/or uninstall the one or more arrays to the light box housing. As further seen in FIGS. 12*a-c*, the arrays are mounted to the cross bar using any one of the mounting brackets discussed herein, whereas the end of the array opposite the cross bar may or may not comprise a mounting bracket. The end of the array opposite the cross bar can be mounted to the light box housing or a structure or surface within the light box housing. In yet other embodiments, the end of the array opposite the cross bar can be mounted to a second cross bar wherein the cross bar and the second cross bar are mounted within the light box housing in order to mount the arrays within the light box housing. The second cross bar can be an external element independent of the light box housing or can be an internal component of the light box housing.

The mounting bracket can be made of any suitable material including plastics or metals. In one embodiment, mounting bracket can be attached by any of the above mentioned mounting methods including tape, screws, or nails through mounting holes 423. The mounting bracket may be mounted to the sidewalls 108 of a light box housing or to the back 106 of a light box housing. In some embodiments, the mounting bracket comprises at least one support rib 1001 to maintain the bend between the base 420 and the at least one leg 416. As shown in FIGS. 10*a* and 10*b*, the mounting bracket comprises three support ribs 1001 at the bend region between the base 420 and the legs 416. The at least one support rib 1001 prevents the base and the at least one legs of the mounting bracket from losing the form of the bend region. In other embodiments, a mounting bracket 1100 which is similar to the mounting brackets 118 and 810 discussed above, further comprises a socket 1102 and bridge 1104. The mounting bracket 1100 is adapted to be used in light box housings that have elements of previously used lighting solutions, but were not fully removed and/or removable from the light box housing. The socket 1102 accounts for elements that could be extending from the light box housing such that the elements extending from the light box housing do not interfere and/or prevent the mounting bracket 1100 and/or array from being mounted to the light box housing. As shown in FIGS. 11*a* and 11*b*, the socket can be adapted receive an element extending from the light box housing in order to mount the mounting bracket to the position of where the former lighting solution was previously installed, such as but not limited to a fluorescent tube socket. The bridge is adapted to provide support so that the mounting bracket 1100 does not lose its form. In other embodiments, as in FIG. 11*b*, the mounting bracket 1100 can comprise a lip 1106 on its base 1108 which also is arranged to provide structural support, instead of having the bridge. While in yet other embodiments, the mounting bracket 1100 can comprise both the lip 1106 and the bridge. The lip 1106 and bridge can be arranged in many different ways and is not intended to be limited to the embodiments disclosed herein.

In double sided light box housings, which outputs light through the face and back of the light box housing, a plurality of arrays of lighting units 110 may be mounted back-to-back by any of the methods discussed above. In another embodiment wherein the double sided light box housing is used, an array of double-sided lighting units 300 can be used instead of mounting a plurality of arrays of lighting units 110 in a back-to-back configuration.

Figure 6A:
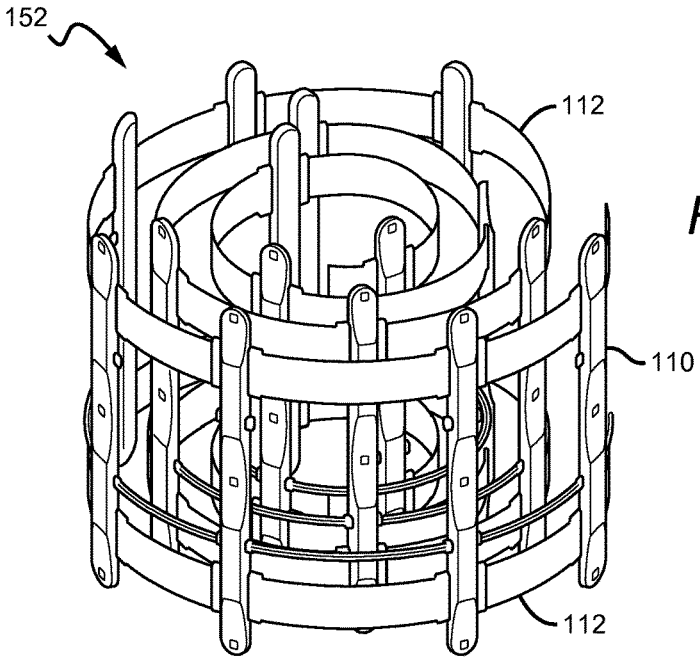
FIG. 6*a* is a perspective view of an array of lighting units according to an embodiment of the invention.
Figure 6B:
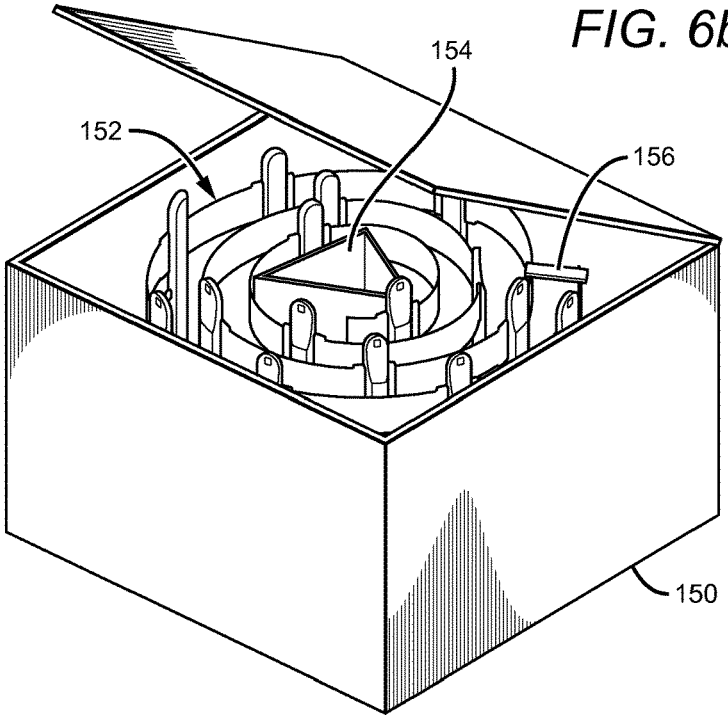
FIG. 6*b* is a perspective view of an array of lighting units according to an embodiment of the invention.
Figure 7:
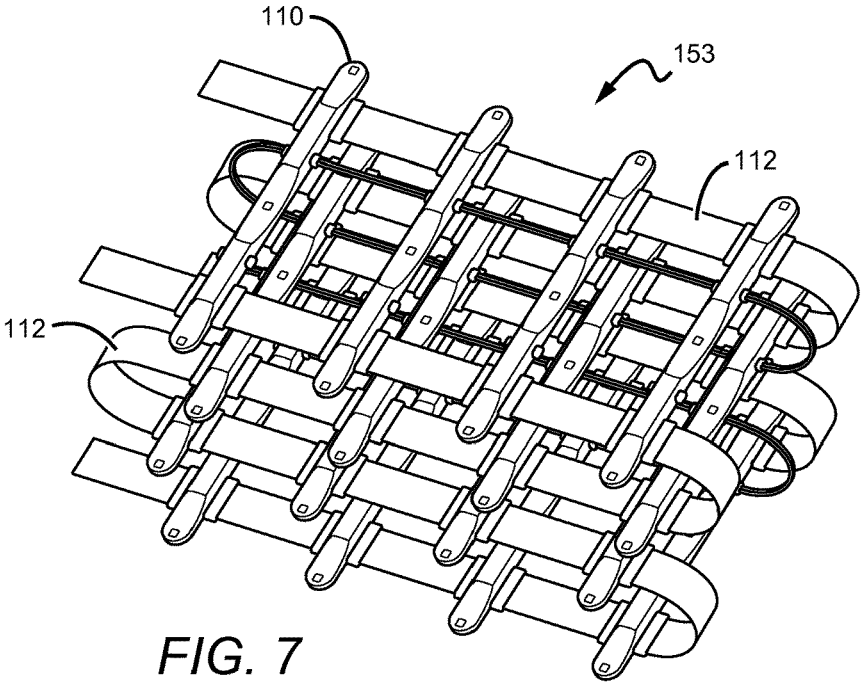
FIG. 7 is a perspective view of an array of lighting units according to an embodiment of the invention.

At least one advantage of mounting the lighting units on the carrier 112 is that the carrier 112 is arranged such that the lighting units mounted on the carrier can be stored in a folded or rolled configuration, thereby making it easy to ship and/or store an extended length of lighting units mounted on the carrier. For example, in one embodiment as shown in FIG. 6, a plurality of lighting units 110 are mounted on two carriers 112, wherein each carrier is a flexible carrier and formed of flexible material, such as but not limited to a webbing. The flexible carrier 112 is configured to allow the plurality of lighting units and the flexible carrier to be rolled into a spiral coil forming a coiled array of lighting units 152. The coiled array of lighting units 152 provides an extended length of fully assembled and electrically connected array of lighting units 152 that are ready to be installed out of the box. In the embodiment of FIG. 6, the coiled array 152 is comprised of lighting units 110. However, the coiled array 152 can also be comprised of lighting units 300. The coiled array 152 also comprises the conductors 114, 116 but are not shown in FIG. 6 for ease of illustration. The coiled array of lighting units allows for ease of installation of the lighting units and eliminates the need for an installer to fully assemble an array of electrically connected lighting units mounted onto a carrier of a desired length. The lighting units of the coiled array of lighting units 152 can also comprise the optical element discussed above. In another embodiment, as shown in FIG. 7, a plurality of lighting units 110 are mounted on two carriers 112, wherein each carrier is a flexible carrier and formed of flexible material, such as but not limited to a webbing. The flexible carrier 112 is configured to allow the plurality of lighting units and the flexible carrier to be folded onto itself in a serpentine configuration forming a folded array of lighting units 153. The lighting units of the folded array 153 can also be comprised of lighting units 300 and is not intended to be limited to lighting units 110.

Conventional lighting units are typically arranged as a number of individual lighting units stored in a box or other container, wherein a packaging material has a plurality of slots that receives and holds a respective lighting unit. The packaging material holds the individual lighting units so that the lighting units are not damaged during transit or while they are stored in the box. Each of the conventional lighting units have electrical conductors that are not connected to another conventional lighting unit and would need to be connected to another conventional lighting unit to form an array of lighting units when installed.

In order for an installer to fabricate an array of lighting units on a carrier using the conventional lighting units, the installer would have to measure and cut a blank carrier that does not have anything mounted on it. Typical carriers used with conventional lighting units are rigid and not flexible. Next, each lighting unit would have to be individually mounted onto the carrier and then the electrical conductors of each lighting unit would have to be spliced and soldered to the electrical conductors of adjacent lighting units so that the array of lighting units can be electrically connected. The installer could also form the array first, then mount each individual conventional lighting unit of the array onto the carrier. These processes to fabricate an array of conventional lighting units on a carrier are cumbersome and provide many opportunities for mistakes and/or errors to occur. For instance, the installer could improperly solder the electrical conductors between adjacent conventional lighting units resulting in failure, or the installer could incorrectly measure the length of the carrier necessary thereby creating wasted materials. Furthermore, this process likely causes the soldered connection of electrical conductors between adjacent conventional lighting units to be exposed and not be housed within the conventional lighting unit, whereas the exposed center conductor and the crimp terminals in the invention are arranged in an orderly fashion within the lighting unit.

An advantage of the invention is that the configuration of the flexible carrier 112 and the lighting units 110, 300 mounted on the flexible carrier eliminates the opportunities for mistakes and errors in assembling the array of lighting units because the array of lighting units 152, 153 on the flexible carrier 112 is prefabricated and tested to ensure proper operation. Assembly of the array of lighting units on the flexible carrier merely requires the installer to cut the flexible carrier to create the desired array length of lighting units on the flexible carrier. The desired array length of lighting units can then be mounted in the light box housing 102 using any of the methods discussed above. The invention reduces the amount of time required to install the array of lighting units, which is a time and cost-savings advantage over conventional lighting units. There is no need to mount each individual lighting unit 110, 300 onto the flexible carrier 112, or to splice and solder the electrical conductors between adjacent lighting units 110, 300, because such work has already been performed.

The coiled array of lighting units 152 is arranged to be easily packaged in a box 150. FIG. 6*b* shows the coiled array of lighting units 152 in a pizza-type box comprising a cover hingedly attached to the box. However, other types of boxes, containers or structures having different shapes, sizes and configurations can be used; the application is not intended to be limited to a pizza-type box. FIG. 6*b* shows the coiled array of lighting units 152 in the box 150, wherein a storage support structure 154 is placed in the central opening of the coiled array 152. The coiled array of lighting units 152 can be comprised of any number of lighting units 110, 300. In yet other embodiments, the coiled array of lighting units 152 can be comprised of a vast quantity of lighting units such that the coiled array of lighting units 152 is on a spool, reel or similar structure. The folded array 153 is also adapted to be packaged in a box, in a manner similar to the coiled array of lighting units 152.

The storage support structure 154 can be made of many different materials, such as but not limited to, cardboard, metal, plastic, paper, foam or the like. The storage support structure 154 shown in FIG. 6*b*, is shown as having a triangular shape, but the storage support structure 154 is not intended to be limited to a triangular shape. In other embodiments, the storage support structure 154 can be shaped in many different forms, such as circular, quadrilateral or any other polygonal shape. The storage support structure 154 assists the coiled array 152 in maintaining its coiled shape while in the box 150 during storage and/or transit so that the coiled array 152 is not damaged. In some embodiments, the size or shape of the storage support structure 154 can be modified to accommodate different sized coiled arrays 152. For example, the storage support structure 154 can be made bigger or smaller to accommodate coiled arrays 152 of different sizes. The storage support structure 154 can be formed as part of the box 150 or can be a separate element that is removable and not part of the box 150.

In other embodiments, the coiled array 152 could be stored within the box 150 without the storage support structure 154, wherein at least one bracket 156 is wrapped around part of the coiled array 152 in order to maintain the coiled shaped. The at least one bracket 156 can be made of many different materials, such as but not limited to, plastic, rubber, paper, metal, steel or the like. Additionally, the at least one bracket 156 can be in many different forms, for example, the at least one bracket 156 can be overmolded material that wraps around part of the coiled array 152, a rubber band, a clip, tape, zip-ties, string, wire, rope or the like. Furthermore, the at least one bracket 156 can be configured to be reusable such that the at least one bracket 156 can be removed from the coiled array 152 and then placed back on the coiled array 152. While in other embodiments, the at least one bracket 156 is arranged to be a one-time use bracket. In yet other embodiments, the coiled array 152 could be stored within the box 150 using both the storage support structure 154 and the at least one bracket 156.

The flexible carrier 112 of the coiled array 152 is also arranged such that the flexible carrier 112 is not permanently shaped or bent due to being coiled, or due to being coiled for an extended period of time. The flexible carrier 112 has sufficient elasticity such that when a desired length of the coiled array 152 is uncoiled and detached from the coiled array 152, forming an array of lighting units of desired length, the flexible carrier 112 of the newly formed array is substantially flat and is not permanently curved or bent in a shape that is similar to the shape of the coiled array 152.

The coiled flexible carrier 112 and plurality of lighting units 110, 300 provide an extended length of coiled lighting units 110, 300 that can be cut to a desired length of an array of lighting units. The desired length of the array of lighting units are easy to install in a light box housing due to the array of lighting units being prefabricated, thereby eliminating the need for an installer to measure and cut a desired length of a carrier and then mount the lighting units onto the desired length of the carrier. As such, the flexible carrier and plurality of lighting units increases the efficiency of installing the array of lighting units in light box housings 102 or the like.

Although the invention has been described in considerable detail with reference to certain configurations thereof, other versions are possible. Lighting units according to the invention can be many different sizes and can be used for many different applications beyond light boxes. In other embodiments, a variable power supply can be used to control the intensity of the light emitting elements. The conductors can be different lengths and instead of running uninterrupted between the units. This would allow the power of the lighting units to be supplied separately and then connected together when installed. Therefore, the spirit and scope of the invention should not be limited to the versions described above.

We claim:

1. A lighting system, comprising:

a light box housing comprising a face, a back, and a plurality of sidewalls between said face and said back;

a plurality of electrically interconnected lighting units on at least one woven flexible carrier within said light box housing, wherein electrical interconnections between said plurality of lighting units are separate from said at least one woven flexible carrier and wherein the length of said electrical interconnections between adjacent ones of said lighting units is longer than the distance between said adjacent lighting units such that said interconnection are relaxed between, wherein said at least one woven flexible carrier receives each of said plurality of electrically interconnected lighting units, said plurality of electrically interconnected lighting units comprising:

a printed circuit board (PCB) having a first surface and a second surface, wherein said PCB is substantially planar; and at least one light emitting element on said first surface of said PCB, wherein said PCB is mounted to said at least one woven flexible carrier;

a mounting mechanism adapted to secure said at least one woven flexible carrier to said light box housing, wherein said plurality of interconnected lighting units are adapted to emit light in a substantially uniform light distribution pattern, wherein said mounting mechanism comprises at least one clamp arranged to receive a respective one of opposing ends of said at least one woven flexible carrier to mount said plurality of interconnected lighting units to said light box housing.

2. The lighting system of claim 1, wherein each of said plurality of interconnected lighting units are on two woven flexible carriers, such that each of said plurality of interconnected lighting units are aligned with each other.

3. The lighting system of claim 2, wherein said woven flexible carriers are mounted to said PCB at opposing ends of said PCB.

4. The lighting system of claim 1, wherein said at least one woven flexible carrier comprises a plurality of carrier holes and each of said PCBs comprises at least one slot, wherein said carrier hole of said at least one woven flexible carrier is aligned with a respective slot of said PCB in order to couple said PCBs to said at least one woven flexible carrier.

5. The lighting system of claim 4, wherein a fastener is received by the aligned carrier hole and slot in order to couple each of said PCBs to said at least one woven flexible carrier about a respective one of said carrier hole.

6. The lighting system of claim 1, wherein each of said plurality of interconnected lighting units further comprising a housing adapted to cover at least part of said PCB and said at least one woven flexible carrier.

7. The lighting system of claim 6, wherein said housing is an overmold housing overmolded onto at least part of said PCB and said at least one woven flexible carrier.

8. The lighting system of claim 1, wherein each of said plurality of interconnected lighting units is electrically coupled to conductors adapted to provide an electrical signal to each of said plurality of interconnected lighting units.

9. The lighting system of claim 8, wherein each PCB of said plurality of interconnected lighting units comprises terminals to receive said conductors.

10. The lighting system of claim 1, wherein said mounting mechanism comprises at least one pair of mounting brackets mounted to opposing sidewalls of said light box housing, each of said mounting brackets comprising:

a base; and at least one leg extending from said base, wherein said base is mounted to said sidewall of said light box housing and said plurality of lighting units are mounted to said at least one leg of each of said opposing mounting brackets.

11. The lighting system of claim 10, wherein said mounting brackets further comprise a socket and a bridge, wherein said socket is proximate said base and adapted to accommodate at least one existing lighting solution element, and said bridge proximate said socket and adapted to provide structural support to said mounting bracket.

12. The lighting system of claim 10, wherein said mounting brackets further comprise a socket proximate said base and a lip proximate said base and opposite said socket, said lip adapted to provide structural support.

13. The lighting system of claim 1, said at least one clamp comprising:

a front plate;

a back plate, wherein each of said front and back plate comprise a plurality of recesses, a plurality of projections and at least one aperture; and a hinge, wherein said front plate is hingedly coupled to said back plate;

wherein said back plate comprises a stop and said front plate comprises a tongue, such that said tongue is adapted to be received by said stop when said at least one clamp is closed, whereby said at least one clamp is adapted to be coupled to said at least one woven flexible carrier.

14. The lighting system of claim 13, wherein said plurality of projections of said front and back plate adapted to contact a respective side of said at least one woven flexible carrier and hold said at least one woven flexible carrier in place when said at least one clamp is closed.

15. The lighting system of claim 13, wherein said at least one aperture of said front and back plate adapted to form a channel when said at least one clamp is closed.

16. The lighting system of claim 15, wherein said channel is adapted to receive a fastener in order to mount said at least one clamp to said light box housing.

17. The lighting system of claim 16, wherein each of said plurality of lighting units further comprising a housing adapted to cover at least part of said at least one woven flexible carrier proximate said PCB, said housing comprising a first shoe and a second shoe around said at least one woven flexible carrier proximate said PCB on opposite sides of said housing.

18. The lighting system of claim 13, wherein said plurality of recesses of said front and back plates adapted to form a pocket on opposing ends of said at least one clamp when said at least one clamp is closed.

19. The lighting system of claim 1, wherein said at least one clamp further comprises a clamp bracket such that said at least one clamp is adapted to be slidably received.

20. A lighting system, comprising:

a light box housing comprising a face, a back, and a plurality of sidewalls between said face and said back;

a plurality of interconnected lighting units on at least one woven flexible carrier within said light box housing, each of said of plurality of interconnected lighting units comprising:

a printed circuit board (PCB) having a first surface and a second surface, wherein said PCB is substantially planar; and at least one light emitting element on said first surface of said PCB, wherein said PCB is mounted to said at least one woven flexible carrier;

a mounting mechanism adapted to secure said at least one woven flexible carrier to said light box housing, wherein said plurality of interconnected lighting units are adapted to emit light in a substantially uniform light distribution pattern, wherein said mounting mechanism comprises at least one clamp adapted to mount said plurality of interconnected lighting units to said light box housing, wherein said at least one clamp is arranged to receive a respective one of opposing ends of said at least one woven flexible carrier to mount said plurality of interconnected lighting units to said light box housing, said at least one clamp comprising:

a front plate;

a back plate, wherein each of said front and back plate comprise a plurality of recesses, a plurality of projections and at least one aperture; and a hinge, wherein said front plate is hingedly coupled to said back plate;

wherein said back plate comprises a stop and said front plate comprises a tongue, such that said tongue is adapted to be received by said stop when said at least one clamp is closed, whereby said at least one clamp is adapted to be coupled to said at least one woven flexible carrier, wherein said at least one aperture of said front and back plate adapted to form a channel when said at least one clamp is closed, wherein said channel is adapted to receive a fastener in order to mount said at least one clamp to said light box housing;

wherein each of said plurality of lighting units further comprising a housing adapted to cover at least part of said at least one woven flexible carrier proximate said PCB, said housing comprising a first shoe and a second shoe around said at least one woven flexible carrier proximate said PCB on opposite sides of said housing, wherein one of said first or second shoe is disposed within one of said plurality of recesses of said front or back plates when said at least one clamp is closed.

21. The lighting system of claim 20, wherein said plurality of light emitting elements are on the same surface of said PCB, such that each of said plurality of lighting units is arranged in a single-sided configuration.

22. The lighting system of claim 20, wherein said plurality of light emitting elements are on opposing surfaces of said PCBs, such that each of said plurality of lighting units is arranged in a double-sided configuration.

23. The lighting system of claim 22, wherein each of said plurality of lighting units comprises a conductor on each of said opposing surfaces of said PCB to provide said electrical signal to said light emitting elements on said opposing surfaces of said PCB.

24. The lighting system of claim 20, wherein said at least one woven flexible carrier is comprised of a webbing formed of strong fabric woven as a flat strip.

25. The lighting system of claim 24, wherein said at least one woven flexible carrier is a multi-paneled webbing.

26. The lighting system of claim 24, wherein said webbing is flexible and able to provide structural support to said lighting units.

27. An array of lighting units, comprising:

a plurality of woven flexible carriers; and a plurality of lighting units mounted to said plurality of woven flexible carriers, wherein said plurality of lighting units are electrically connected to each other, each of said plurality of lighting units comprising:

a plurality of light emitting elements on a first surface of a printed circuit board (PCB);

first and second conductors electrically connected to said PCB, wherein said first and second conductors are electrically connected to each of said plurality of lighting units and separate from said plurality of woven flexible carriers;

an overmold housing on at least a portion of each surface of said PCB and a portion of said at least one woven flexible carrier;

wherein the separation between adjacent lighting units of said plurality of lighting units on said plurality of woven flexible carriers is substantially similar;

wherein each of said plurality of woven flexible carriers is substantially exposed between adjacent PCBs such that each of said plurality of woven flexible carriers can at least partially bend between adjacent PCBs;

wherein respective ends of said plurality of woven flexible carriers are coupled together using a coupler, said coupler comprising:

at least one clamp comprising a clamp bracket; and a clamp connector adapted to be received by said clamp bracket of said at least one clamp, wherein a bolt is received by said at least one clamp and said clamp connector to couple said coupler to said plurality of woven flexible carriers.

28. The array of lighting units of claim 27, wherein said plurality of woven flexible carriers are adapted to bend freely in many different directions, such that each of said plurality of woven flexible carriers can substantially return to its original state.

29. The array of lighting units of claim 27, wherein said plurality of lighting units and said plurality of woven flexible carriers are adapted to be coiled to form a coiled array of lighting units.

30. The array of lighting units of claim 27, wherein each of said plurality of woven flexible carriers comprises a plurality of carrier holes, such that a respective one of said plurality of lighting units is coupled to said plurality of woven flexible carriers about a respective one of said plurality of carrier holes.

31. The array of lighting units of claim 30, wherein said plurality of carrier holes are equally spaced apart such that the plurality of lighting units coupled to said plurality of woven flexible carriers are equally spaced apart.

32. The array of lighting units of claim 30, wherein the positioning of said lighting units can be adjusted by mounting said PCB to different carrier holes of said plurality of woven flexible carriers.

33. The array of lighting units of claim 27, wherein at least one of said plurality of woven flexible carriers arranged to be comprised of a plurality of woven flexible carriers coupled together.

34. The array of lighting units of claim 27, wherein said at least one clamp comprising:

a front plate;

a back plate; and a hinge, wherein said front and back plate are hingedly coupled to each other;

said front and back plates comprising a plurality of projections, at least one aperture, and a plurality of recesses;

said back plate comprising a first and a second extension extending from said back plate, wherein a first flange extends from said first extension and a second flange extends from said second extension, such that said first and second flanges extend towards each other.

35. The array of lighting units of claim 34, wherein said back plate comprises a stop and said front plate comprises a tongue, such that said tongue is adapted to be received by said stop when said at least one clamp is closed, whereby said at least one clamp is coupled to said respective end of said woven flexible carriers.

36. The array of lighting units of claim 34, wherein said plurality of projections of said front and back plate are adapted to contact a respective side of said woven flexible carriers and hold said woven flexible carriers in place when said at least one clamp is closed.

37. The lighting system of claim 34, wherein said at least one aperture of said front and back plate is adapted to form a channel when said at least one clamp is closed.

38. The lighting system of claim 37, wherein said channel is adapted to receive a bolt in order to couple said coupler to said respective ends of said woven flexible carriers.

39. The array of lighting units of claim 34, wherein said recesses of said front and back plates are adapted to form a pocket on opposing ends of said at least one clamp when said at least one clamp is closed.

40. The array of lighting units of claim 27, wherein said plurality of woven flexible carriers are comprised of a webbing formed of woven fabric.

41. The array of lighting units of claim 27, wherein said plurality of woven flexible carriers are formed of cotton, nylon, polyester, polypropylene, or a combination thereof.

42. The array of lighting units of claim 27, wherein said array of lighting units is arranged to provide an extended length of fully assembled and electrically connected array of lighting units on said plurality of woven flexible carriers.

43. A lighting system, comprising:

a light box housing comprising a face, a back, and a plurality of sidewalls between said face and said back;

a plurality of electrically interconnected lighting units on at least one woven flexible carrier within said light box housing, wherein electrical interconnections between said plurality of lighting units are separate from said at least one woven flexible carrier, wherein said at least one woven flexible carrier receives each of said of plurality of electrically interconnected lighting units, said plurality of electrically interconnected lighting units comprising:

a printed circuit board (PCB) having a first surface and a second surface, wherein said PCB is substantially planar; and at least one light emitting element on said first surface of said PCB, wherein said PCB is mounted to said at least one woven flexible carrier;

a mounting mechanism securing said at least one woven flexible carrier to said light box housing, said mounting mechanism comprising at least one pair of mounting brackets coupled to opposing sidewalls of said light box housing, wherein each of said mounting brackets comprises an elongated mount surface to mount a respective one of said at least one woven flexible carrier, wherein part of said elongated mount surface at least partially extends beyond one of said plurality of interconnected lighting units, at least one clamp comprising a front plate and a back plate, wherein each of said front and back plate comprises at least one aperture, wherein each of said at least one clamp receives a respective one of opposing ends of said at least one woven flexible carrier; and a fastener that inserts through said aperture of the front and back plate of the clamp, the woven flexible carrier, and the mounting brackets in order to mount said at least one clamp to said light box housing;

wherein said plurality of interconnected lighting units are adapted to emit light in a substantially uniform light distribution pattern.

* * * * *